US007435888B2

(12) United States Patent
Steele

(10) Patent No.: US 7,435,888 B2
(45) Date of Patent: Oct. 14, 2008

(54) ELECTRONIC DRUM PEDAL

(76) Inventor: Mark David Steele, 1931 Waterford Estates Dr., New Smyrna Beach, FL (US) 32168

( * ) Notice: Subject to any disclaimer, the term of this patent is extended or adjusted under 35 U.S.C. 154(b) by 0 days.

(21) Appl. No.: 11/928,353

(22) Filed: Oct. 30, 2007

(65) Prior Publication Data

US 2008/0072737 A1 Mar. 27, 2008

Related U.S. Application Data

(63) Continuation-in-part of application No. 11/440,022, filed on May 25, 2006, which is a continuation-in-part of application No. 10/873,344, filed on Jun. 21, 2004, now Pat. No. 7,074,997.

(51) Int. Cl.
*G10D 13/02* (2006.01)

(52) U.S. Cl. ..... 84/422.1; 84/426

(58) Field of Classification Search ..... 84/422.1, 84/422, 426, 104, 411, 72, 225, 229, 353, 84/366

See application file for complete search history.

(56) References Cited

U.S. PATENT DOCUMENTS

| | | | | |
|---|---|---|---|---|
| 3,598,011 | A | 8/1971 | Henkle | |
| 3,988,957 | A | 11/1976 | Escamilla | |
| 3,994,197 | A | 11/1976 | Bills | |
| 4,188,853 | A * | 2/1980 | Bills | 84/422.1 |
| 4,262,576 | A * | 4/1981 | Gorsky et al. | 84/422.1 |
| 4,491,050 | A | 1/1985 | Franzmann | |
| 4,744,279 | A | 5/1988 | Livingston | |
| 4,782,733 | A | 11/1988 | Herring | |
| 4,817,485 | A | 4/1989 | Bozzio et al. | |
| 4,841,830 | A | 6/1989 | Yamashita | |
| 5,090,289 | A | 2/1992 | Holcomb | |
| 5,396,826 | A * | 3/1995 | Lombardi | 84/422.1 |
| 5,591,929 | A | 1/1997 | Wellman | |
| 5,866,830 | A | 2/1999 | Onyszkanycz | |
| 6,002,076 | A | 12/1999 | Karn | |
| 6,255,574 | B1 | 7/2001 | Sapienza | |
| 6,278,046 | B1 * | 8/2001 | Sikra et al. | 84/422.1 |
| 6,369,308 | B1 | 4/2002 | Orr | |
| 6,541,686 | B2 | 4/2003 | O'Donnell | |
| 6,649,819 | B1 | 11/2003 | Boegli | |
| 6,664,457 | B1 | 12/2003 | King | |
| 6,683,240 | B1 | 1/2004 | Cubranich | |
| 7,074,997 | B2 * | 7/2006 | Steele | 84/422.1 |
| 2004/0025667 | A1 * | 2/2004 | Hampton, Jr. | 84/426 |

(Continued)

*Primary Examiner*—Walter Benson
*Assistant Examiner*—Jianchun Qin
(74) *Attorney, Agent, or Firm*—William C. Schrot; Berenato, White & Stavish, LLC

(57) ABSTRACT

The present invention relates to an apparatus for triggering electronic drums having a pedal assembly and a striking assembly spaced therefrom. The pedal assembly includes a base, a first hub body rotatably connected thereto, and an extension extending outwardly from and coupled to the first hub body. The striking assembly includes a base, a second hub body rotatably connected thereto, and a striking device connected to and extending outwardly from the second hub body. The distal end of the striking device is disposed between first and second triggering devices. The first and second hub bodies are coupled together via a connecting rod, which transfers a rotational force therebetween. The striking device contacts the first triggering device when the extension is depressed, and contacts the second triggering device when the extension is raised.

23 Claims, 27 Drawing Sheets

U.S. PATENT DOCUMENTS

2005/0056997 A1 3/2005 Wakitani et al.
2007/0234875 A1* 10/2007 Fisher, IV ..... 84/422.1
2007/0234876 A1* 10/2007 Veiga ..... 84/422.1

* cited by examiner 33
31
173
169
167
B1

ELECTRONIC DRUM PEDAL

CROSS REFERENCE TO RELATED APPLICATION AND CLAIM TO PRIORITY

This application is a continuation-in-part of application Ser. No. 11/440,022, filed May 25, 2006, which is a continuation-in-part of application Ser. No. 10/873,344, filed Jun. 21, 2004, now U.S. Pat. No. 7,074,997, the disclosures of which are incorporated herein by reference and to which priority is claimed under 35 U.S.C. §120.

FIELD OF THE INVENTION

The present invention relates to an apparatus for triggering electronic drums having a pedal assembly and a striking assembly spaced therefrom. The pedal assembly includes a base, a first hub body rotatably connected thereto, and an extension extending outwardly from and coupled to the first hub body. The striking assembly includes a base, a second hub body rotatably connected thereto, and a striking device connected to and extending outwardly from the second hub body. The distal end of the striking device is disposed between first and second triggering devices. The first and second hub bodies are coupled together via a connecting rod, which transfers a rotational force therebetween. The striking device contacts the first triggering device when the extension is depressed, and contacts the second triggering device when the extension is raised.

SUMMARY OF THE INVENTION

The present invention is directed to a drum pedal whereby raising and lowering the foot can trigger two beats instead of one, thus creating sounds at twice the rate of conventional pedals.

The disclosed invention reduces the force required to produce triggering, allowing increased speed and control. In addition, the disclosed invention reduces the momentum inherent in the device, which allows a very rapid return to the start position, increasing speed and control. The disclosed drum pedal may include an adjustable return spring tension, and only one moving part. The disclosed pedal facilitates very rapid, controlled drum beats with a single foot, retaining the use of the hi-hat instrument.

According to a disclosed embodiment, an electronic drum pedal operably associated with sensor pads is provided. Multiple sensors are provided in each pad, so that the drum pedal can combine any of the many sounds available in electronic drums, for example; a low conga and cowbell on the downstroke, with a high conga and tambourine on the upstroke.

In accordance with another embodiment of the invention, there is disclosed a foot pedal apparatus for triggering electronic drums comprising impact sensitive electronic drum triggering devices (pads, tubes or other), a lower tab or pedal or other extension for triggering by pressing down, an upper tab or pedal or other extension for triggering by raising the foot, a method of combining the upper and lower extensions (tab, pedal or other) into a pedal assembly, a hinge or axle or other device which allows the pedal assembly to rotate in an arc, support arms or brackets to hold the axle or shaft, a striking device (stick, rod or other) which is attached to the pedal assembly and hits the impact-sensitive electronic drum triggering devices, a footpad to absorb most of the weight of the foot and leg, and an elastic device or spring which returns the pedal assembly to the neutral position.

The present invention is also directed to an apparatus for triggering electronic drums. The apparatus includes a base, a hub body pivotably connected to the base, an upper tab extending outwardly from the hub body, and a pedal spaced from the upper tab to form a space therebetween for receiving a user's toes. A linkage has a first portion pivotally connected to the hub body and a second portion pivotally connected to the pedal, thereby pivotally connecting the pedal to the hub body. First and second impact sensitive electronic triggering devices are provided. An elongate striking device has a first end connected to the hub body and a second end extending outwardly from the hub body and disposed between the first and second triggering devices. The striking device contacts the first triggering device when the pedal is actuated, and contacts the second triggering device when the upper tab is actuated.

Also disclosed is an apparatus for triggering electronic drums comprising a base, a hub body pivotably connected to the base, a pedal, and a foot retaining device attached to the pedal for securing a user's foot to the pedal. A linkage has a first portion pivotally connected to the hub body and a second portion pivotally connected to the pedal, thereby pivotally connecting the pedal to the hub body. First and second impact sensitive electronic triggering devices are provided. An elongate striking device has a first end connected to the hub body and a second end extending outwardly from the hub body and disposed between the first and second triggering devices. The striking device contacts the first triggering device when the pedal is depressed, and contacts the second triggering device when the pedal is lifted.

Also disclosed is a remotely actuated pedal comprising a striking assembly and a separate pedal assembly. The striking assembly comprises a base pivotally supporting a striking assembly axle, which in turn supports a striking assembly hub body used to mount a striking stick, rod or other device. The free distal end of striking device is disposed between two impact sensitive pads, and a spring is used to return the striking device to an at-rest position between said pads. The pedal assembly comprises a base which pivotally supports the pedal assembly axle, which in turn supports a pedal assembly hub. The pedal assembly hub may be used to support any of pedal configurations disclosed herein. The pedal assembly axle is connected to the striking assembly axle by means of a connecting rod, which can be adjustable in length with one or more universal joints. The joints may be adjusted so that the relative angle of the two assemblies is thereby adjusted. This configuration causes the striking stick to hit the downstroke pad when the performer's foot is lowered, and the upstroke pad to be impacted when the foot is raised. This remote pedal configuration can be used by itself, or used in combination with other devices.

Other advantages of the present invention will become apparent from the following descriptions, taken in connection with the accompanying drawings, wherein, by way of illustration and example, an embodiment of the present invention is disclosed.

BACKGROUND OF THE INVENTION

This invention relates generally to the field of musical instruments and more specifically to a foot pedal for electronic drums.

Conventional drum pedals are widely used, and require significant mechanical leverage to impact a fairly heavy drum beater with the drum head. If the throw of the beater is shortened or the mass is reduced, there is often not enough sound produced. Electronic drums, on the other hand, detect an impact and amplify the sound after computing the proper note or sound as selected by the musician. Heavy beaters with lots of mass and force are no longer required, yet virtually all commercial electronic drum pedals incorporate the old pedal design because, it is thought, that's what drummers are used to. The problem is that the mass and long throw weight inherent in conventional pedals make them unnecessarily slow and hard to control.

FIGS. 9 and 9*a* show conventional drum pedal technology. Drum pedal 101 is hinged at rear 102 and is connected at the front to chain or flexible strap 103. Strap 103 is attached to lever 104 that is suspended on axle 105 using supports 112. Attached to lever 104 is a rod 106 that supports beater head 107. Arm 108 is attached to axle 105 and connected to return spring 109. Spring tension is adjustable using nut 110 that screws onto lower spring attachment bolt 111. Clamp 113 is used to attach the pedal to the shell of bass drum 114. When pedal 101 is pressed down as in FIG. 9*a*, strap or chain 103 is pulled and it in turn rotates lever 104, rod 106 and beater 107 which impacts the surface of a drum pad 115.

The arc of travel for the typical beater 116 is approximately 9 inches in length. Rod 106 and beater 107 typically weigh from one to three pounds. Pedal 101 plus chain 103 can weigh a total of several pounds. In order to move all of this mass back to the starting point, spring 109 typically has a relatively high tension. To counter the force of the spring and to move the pedal rapidly, a relatively large amount of force must be used. A moderate downstroke may require approximately 10 pounds of force, while loud playing may require significantly more. The inherent inertia of existing drum pedals makes rapid successive drum beats impossible, and the long arc of travel of the beater makes timing difficult. Many drummers compensate by adding a second bass drum, or using a remote double bass pedal played with a second foot. In both cases, the hi-hat instrument must be abandoned.

BRIEF DESCRIPTIONS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention. In addition, features of one embodiment may be incorporated into another embodiment.

Figure 2A:
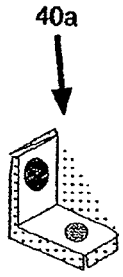
FIG. 2 is a top view of an embodiment of the present invention including stands for pad support.
Figure 2:
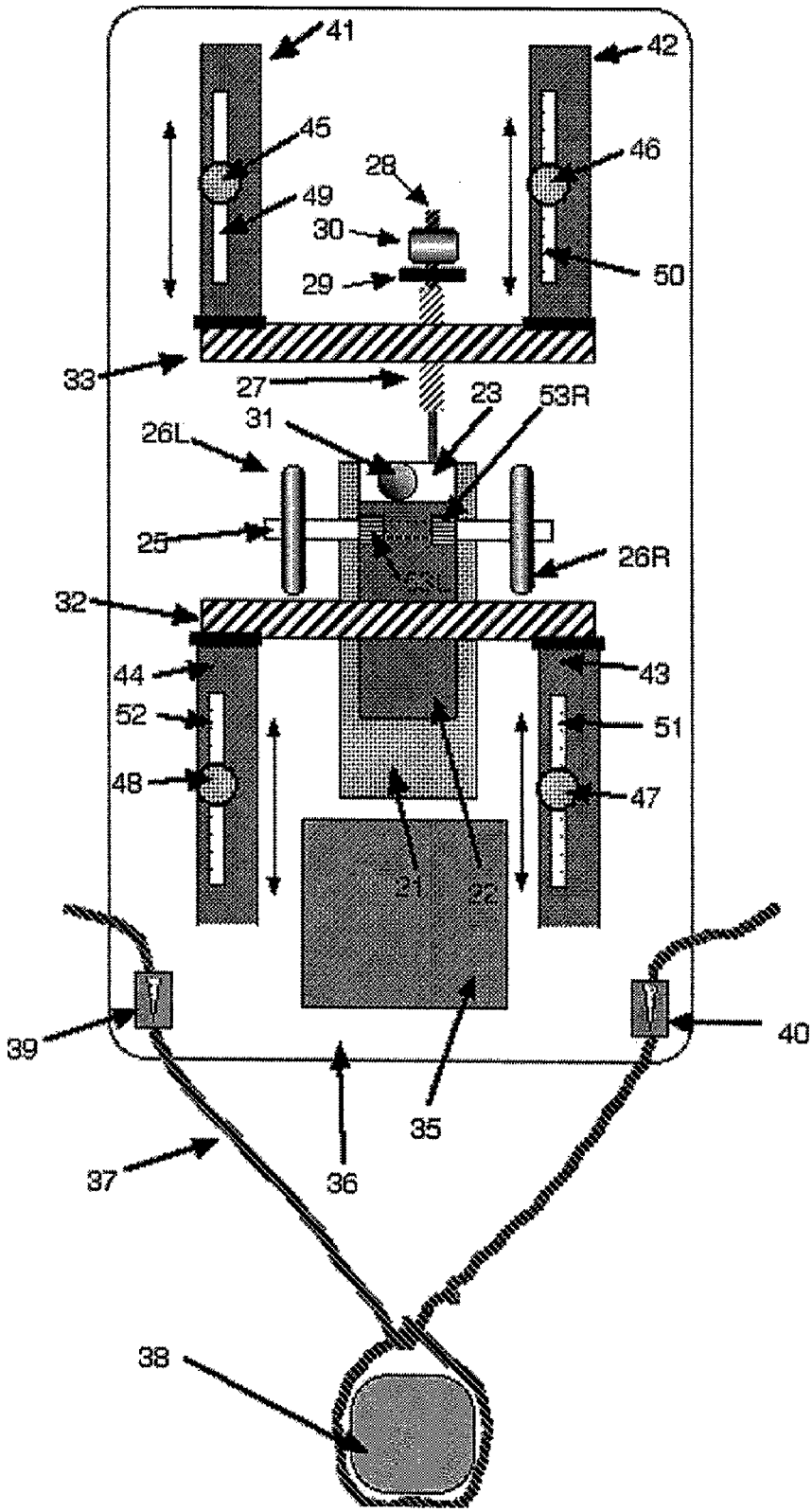
Figure 3:
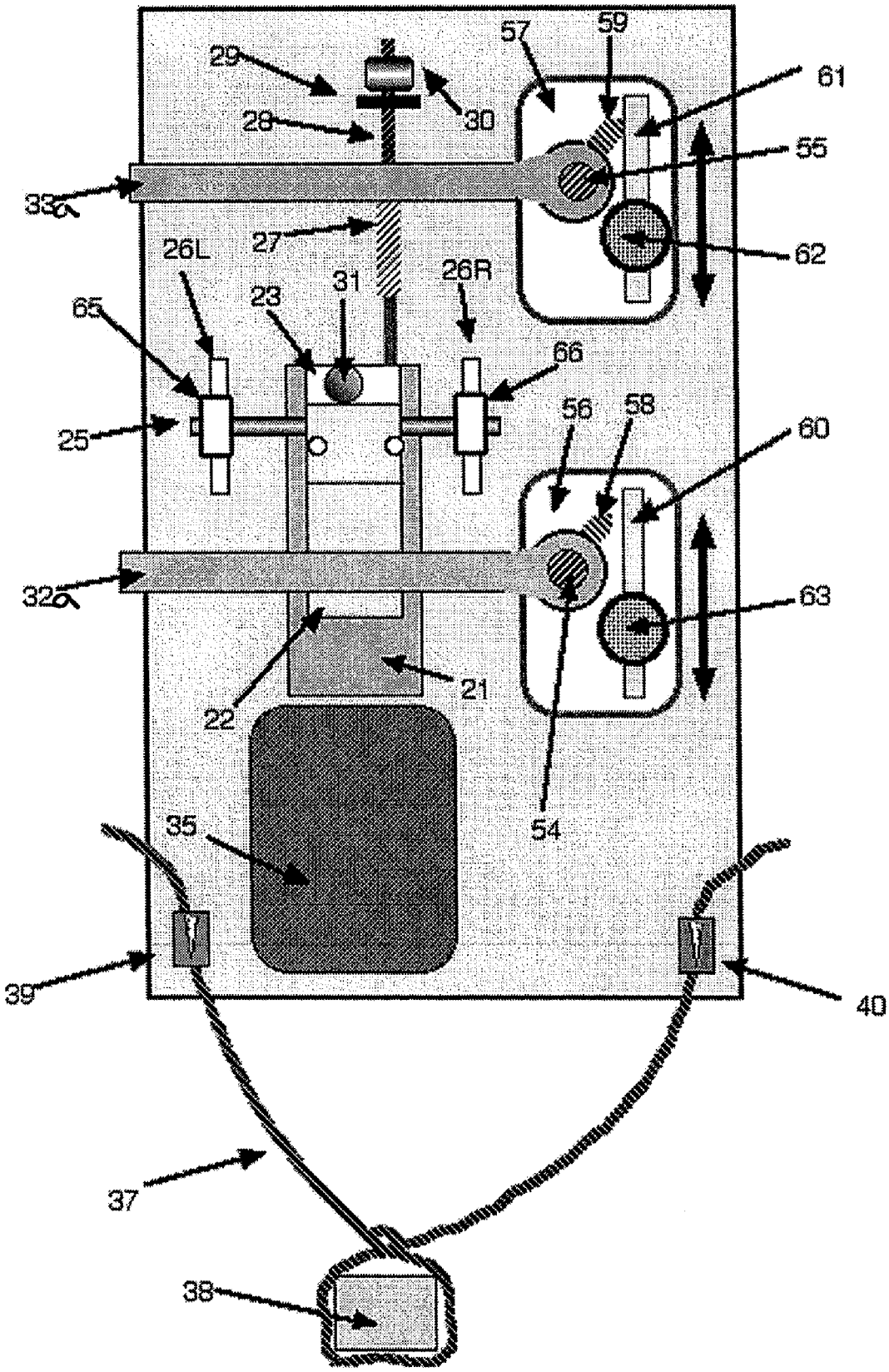
Figure 4:
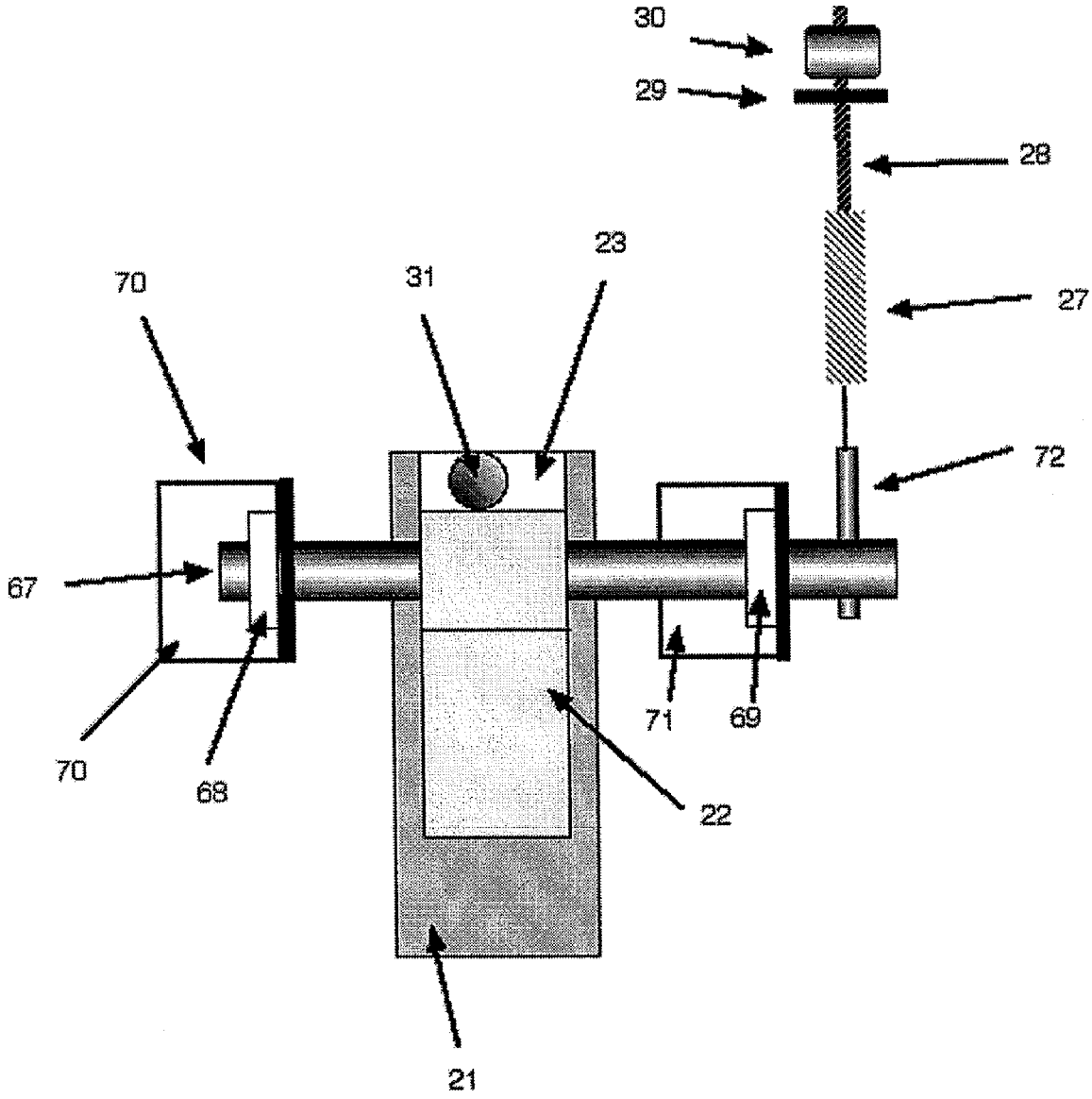
Figure 5:
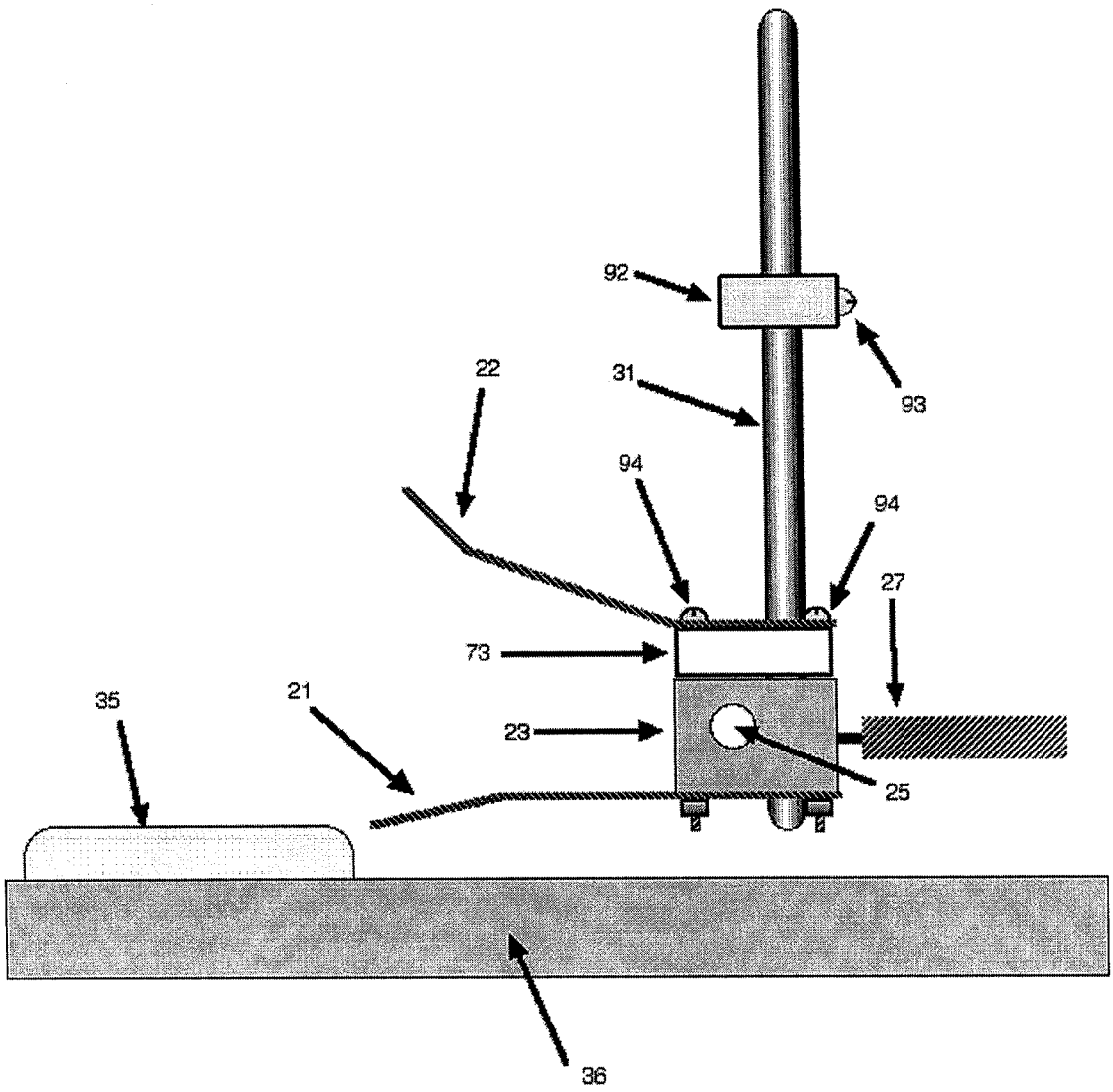
Figure 5A:
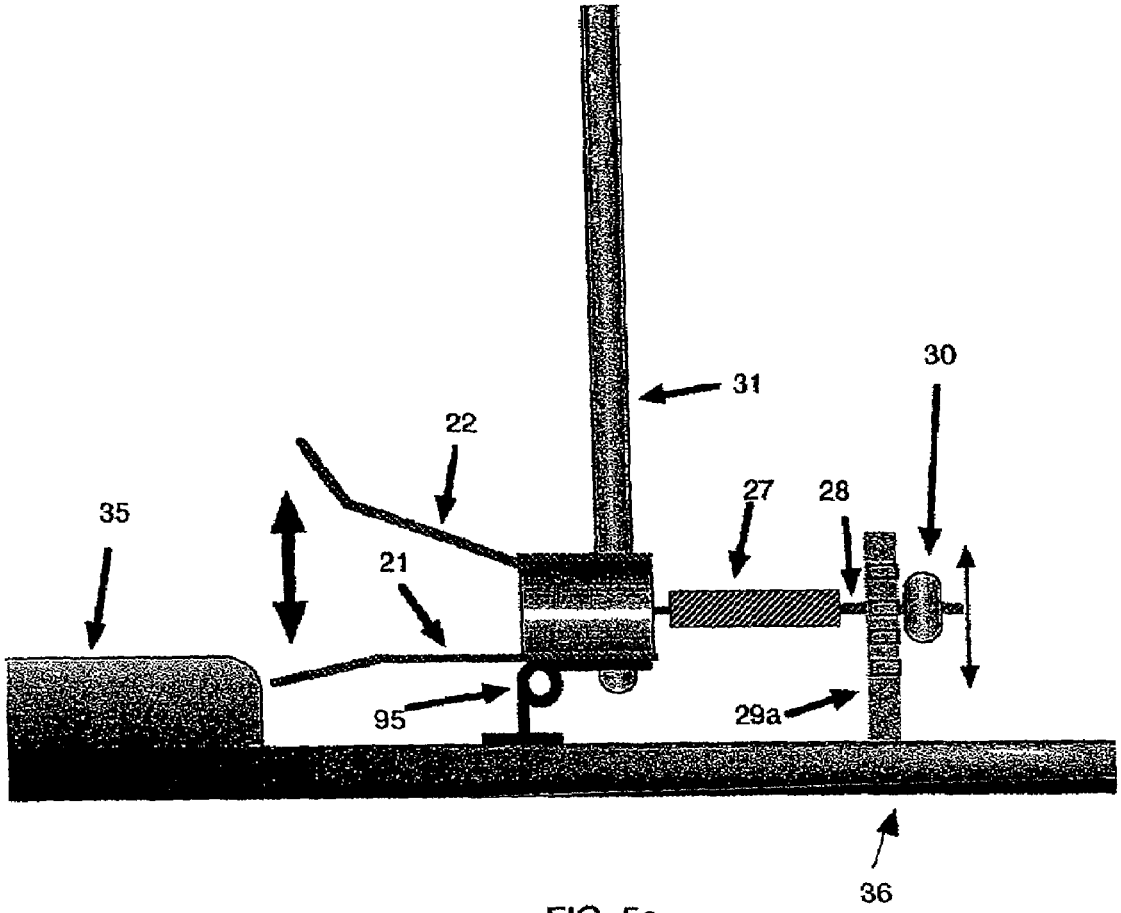
Figure 6:
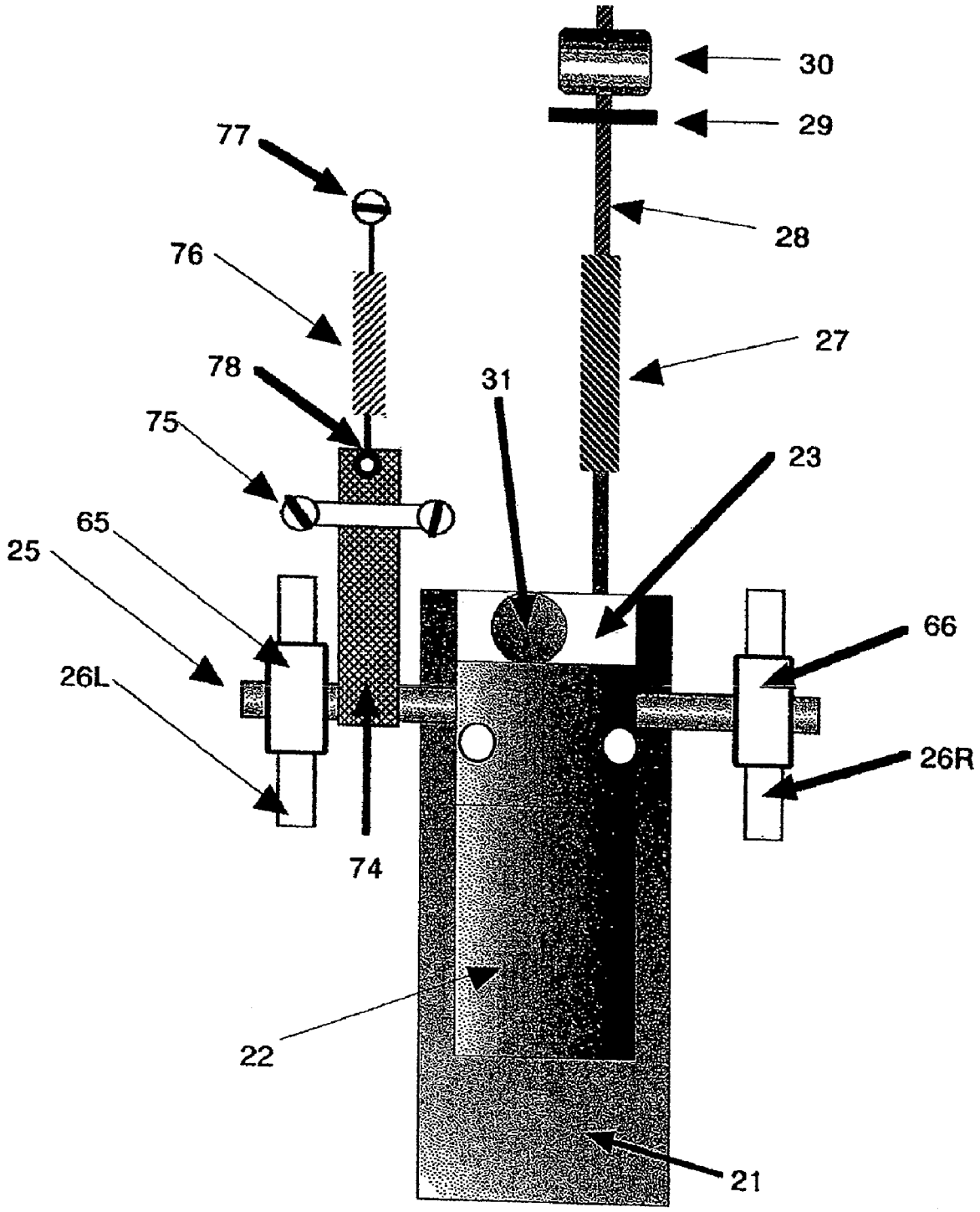
Figure 6A:
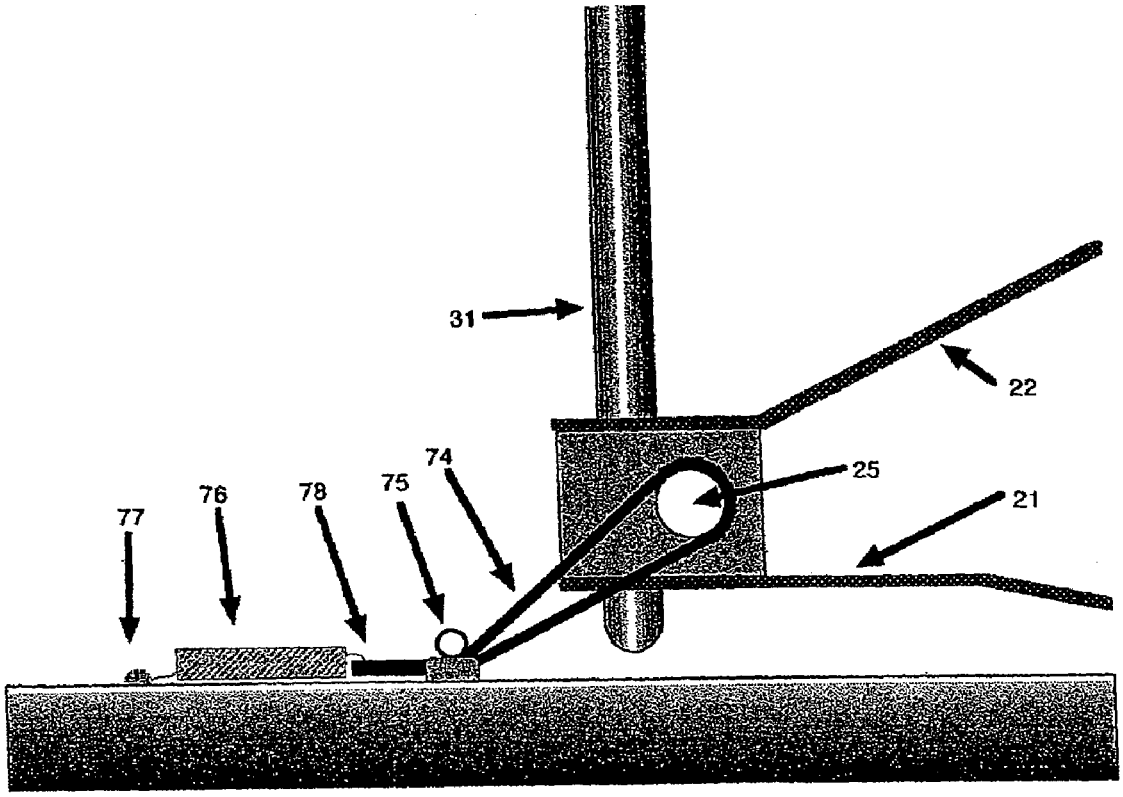
Figure 7:
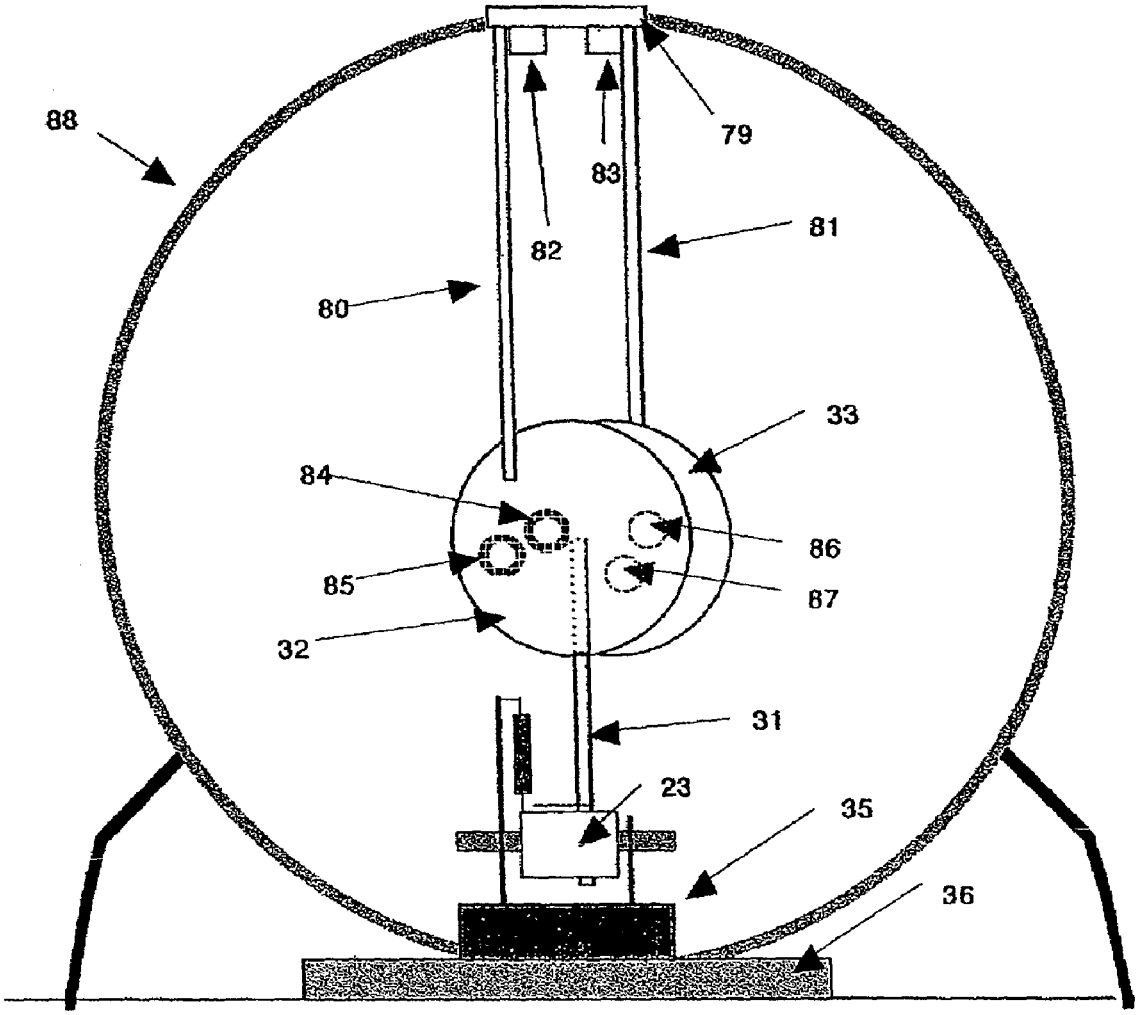
Figure 7A:
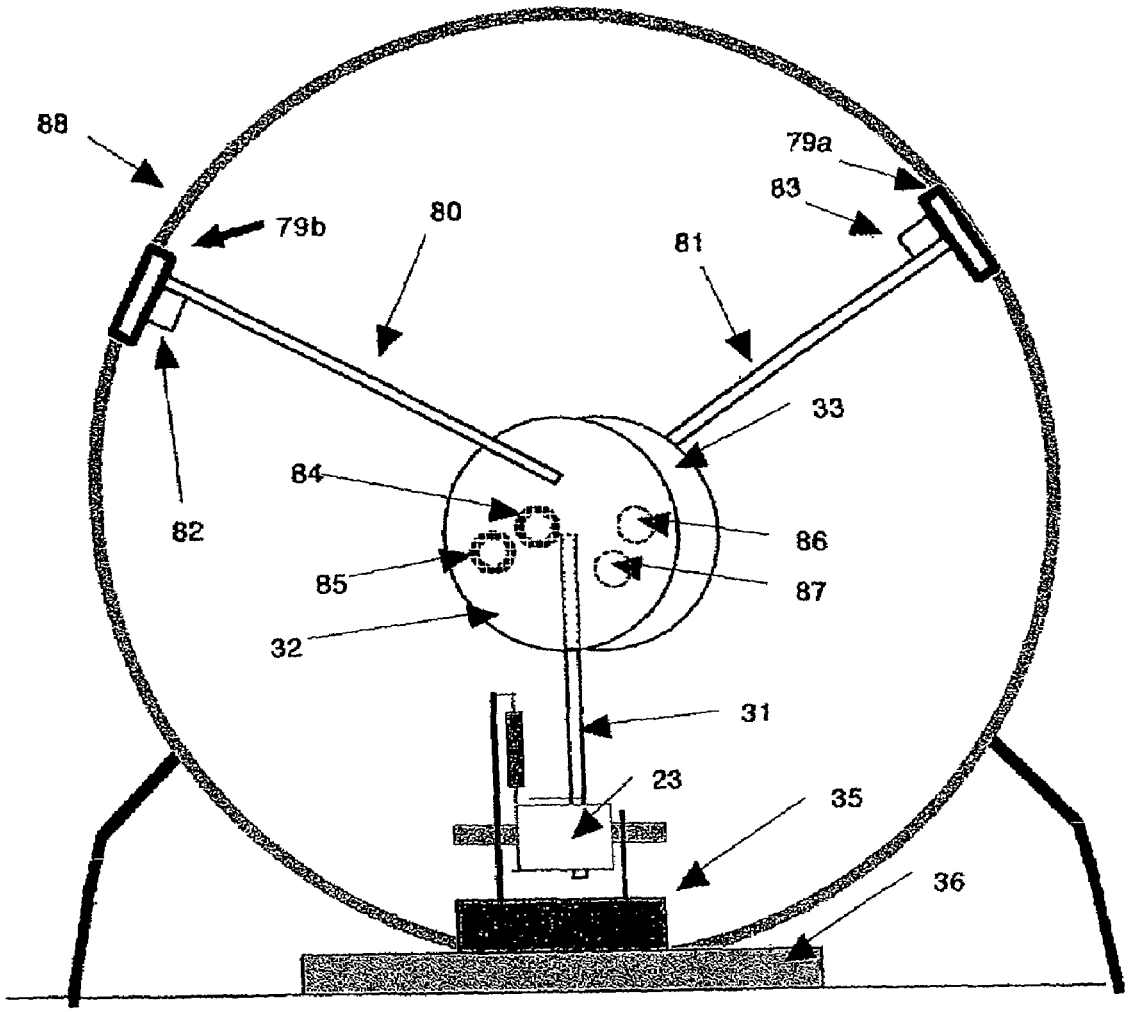
Figure 8:
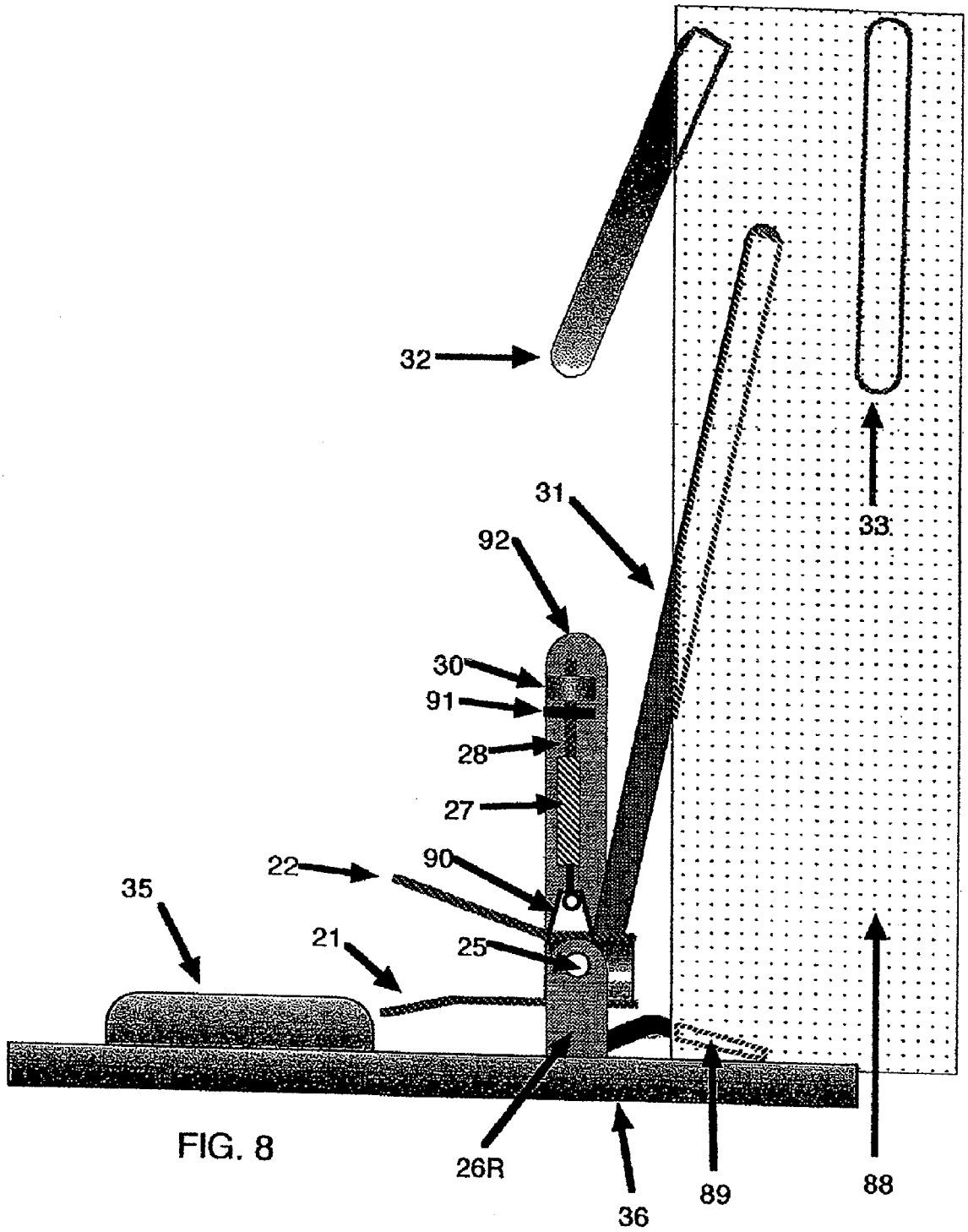
Figure 9:
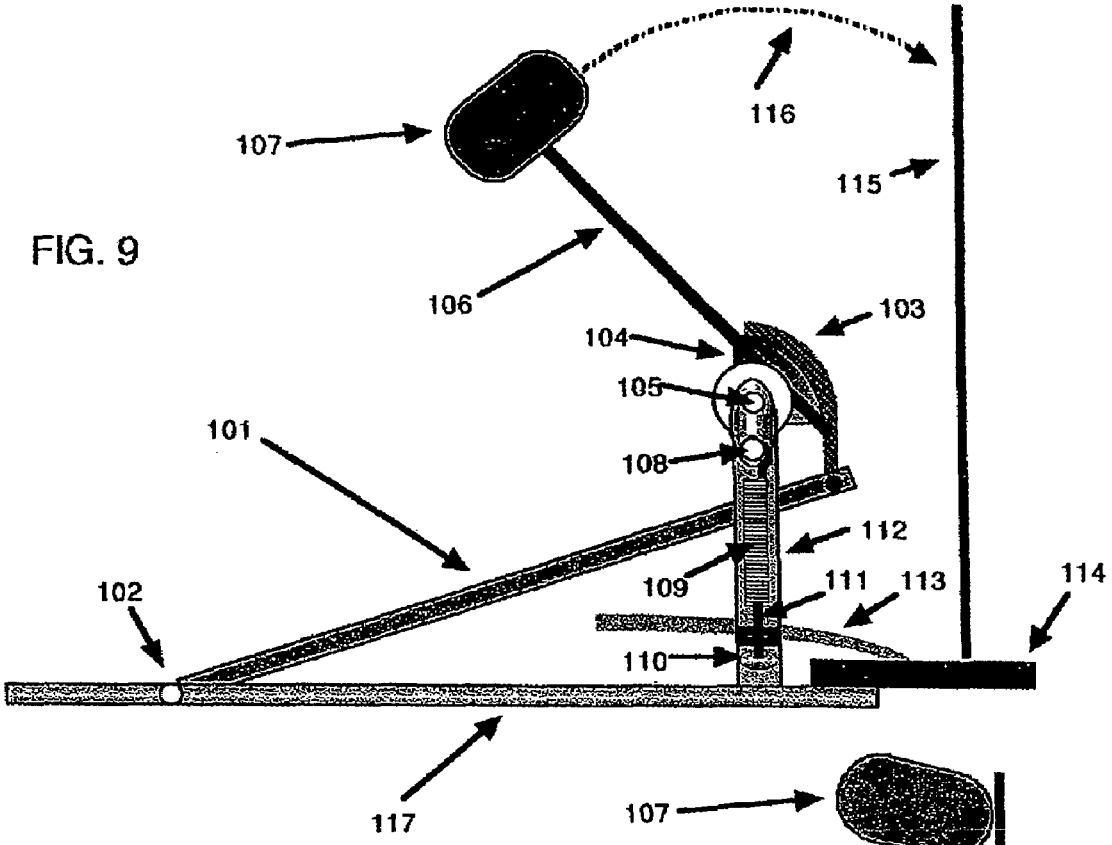
Figure 9A:
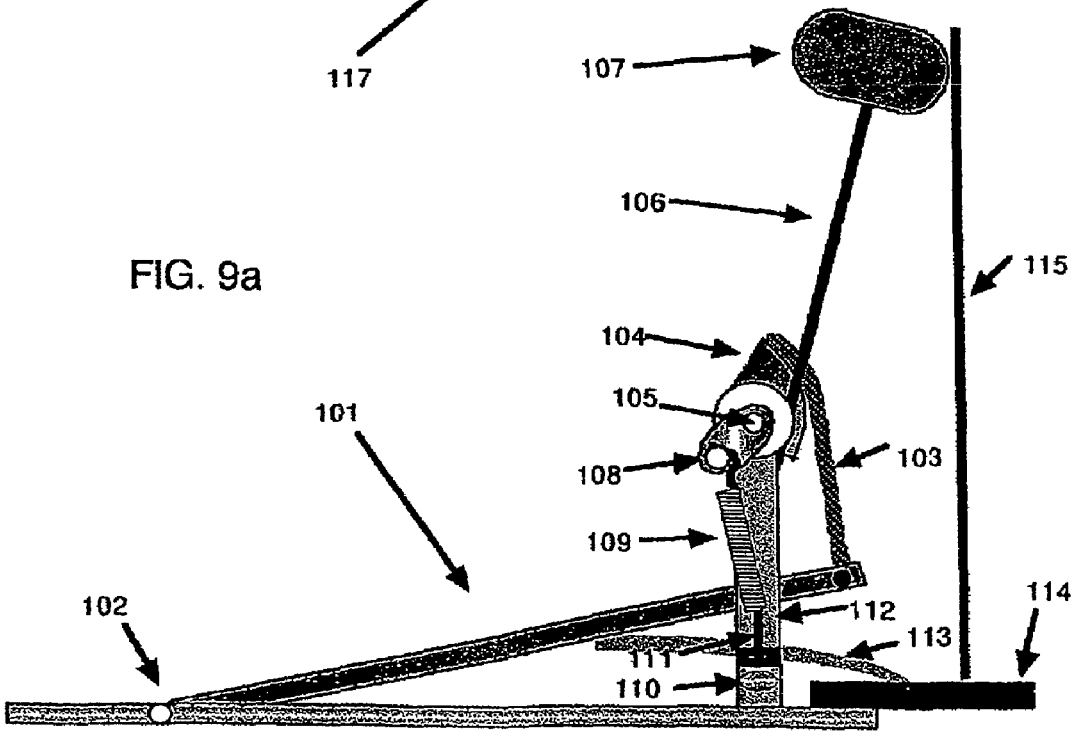
Figure 10:
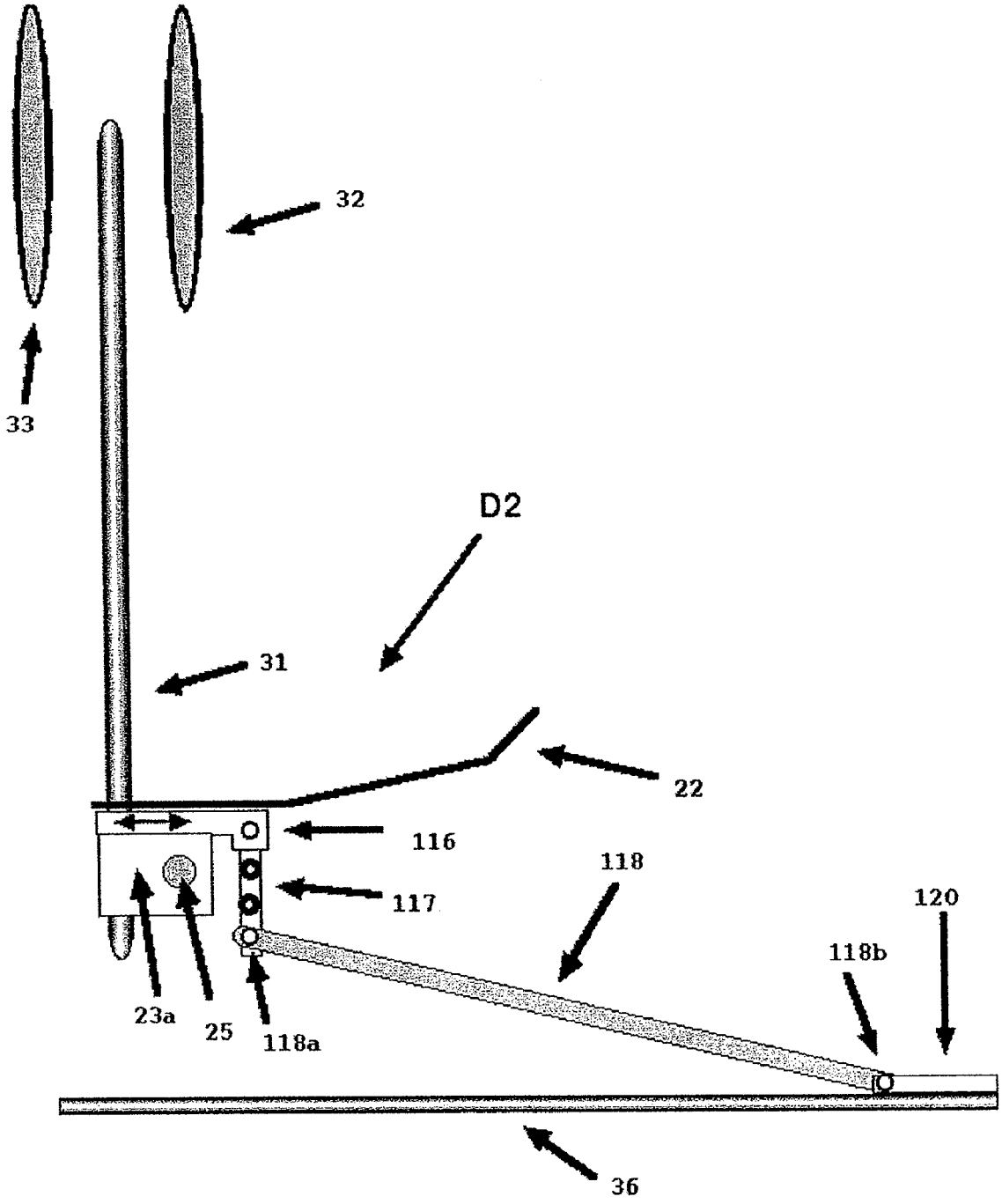
Figure 11:
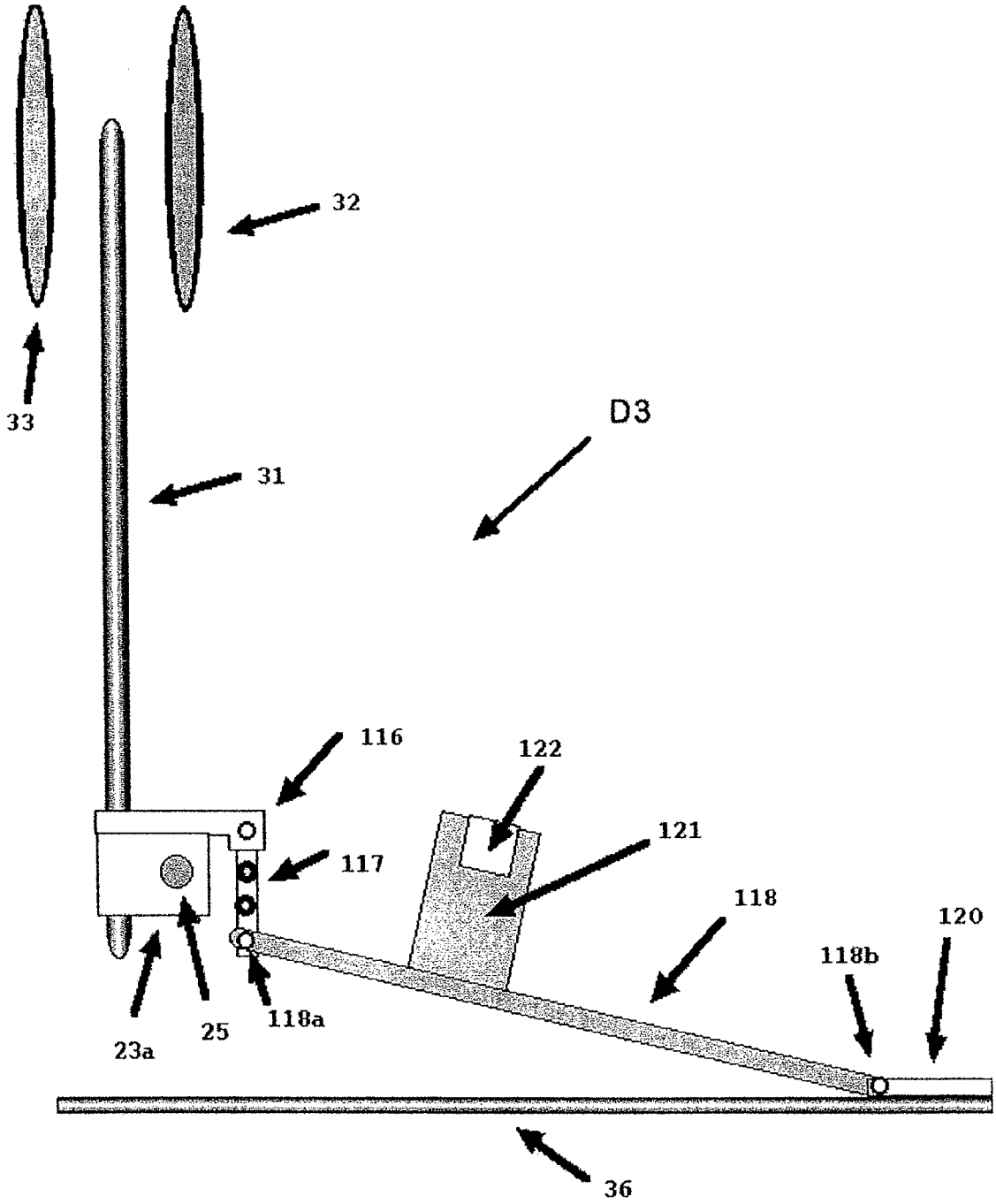
Figure 12:
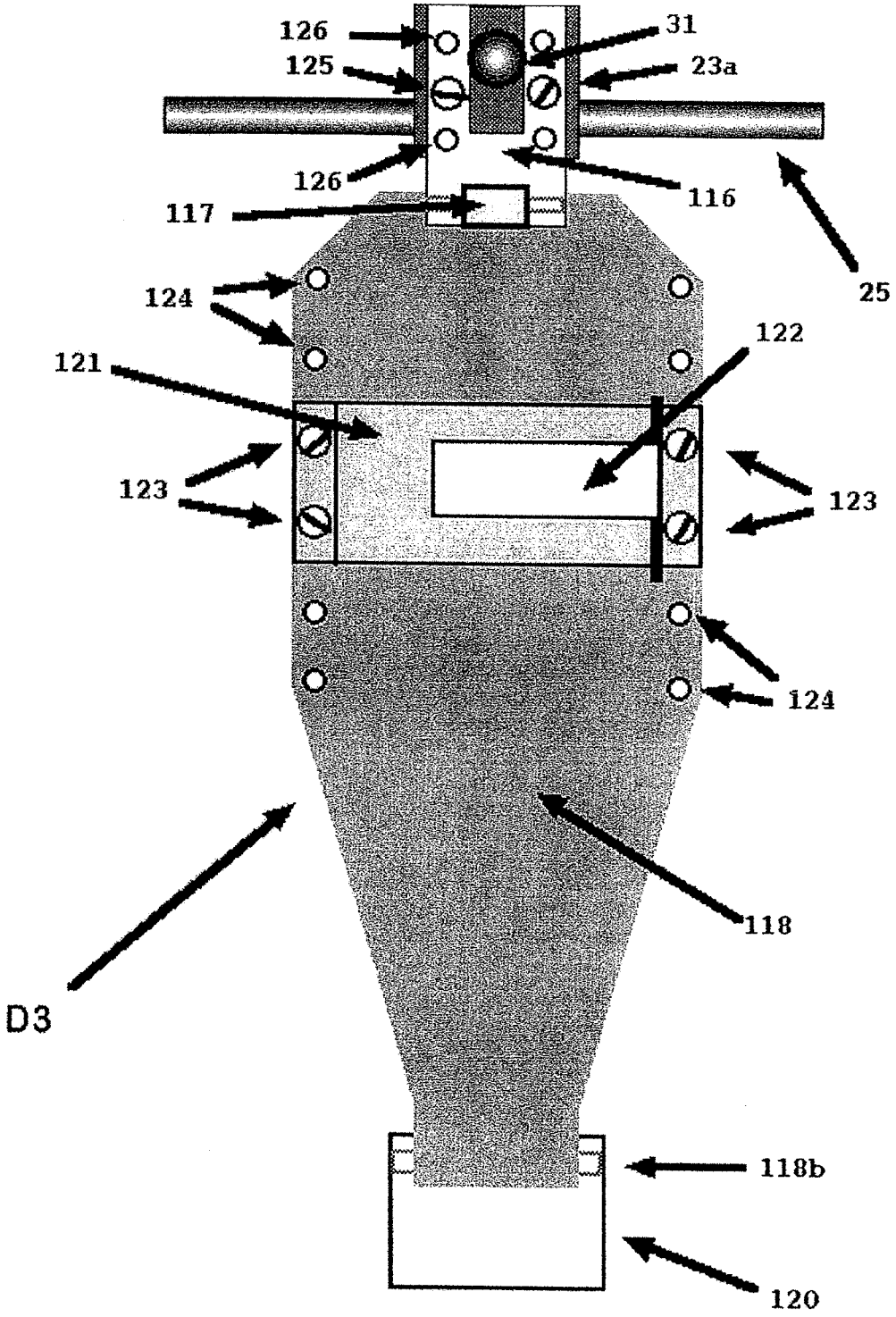
Figure 13:
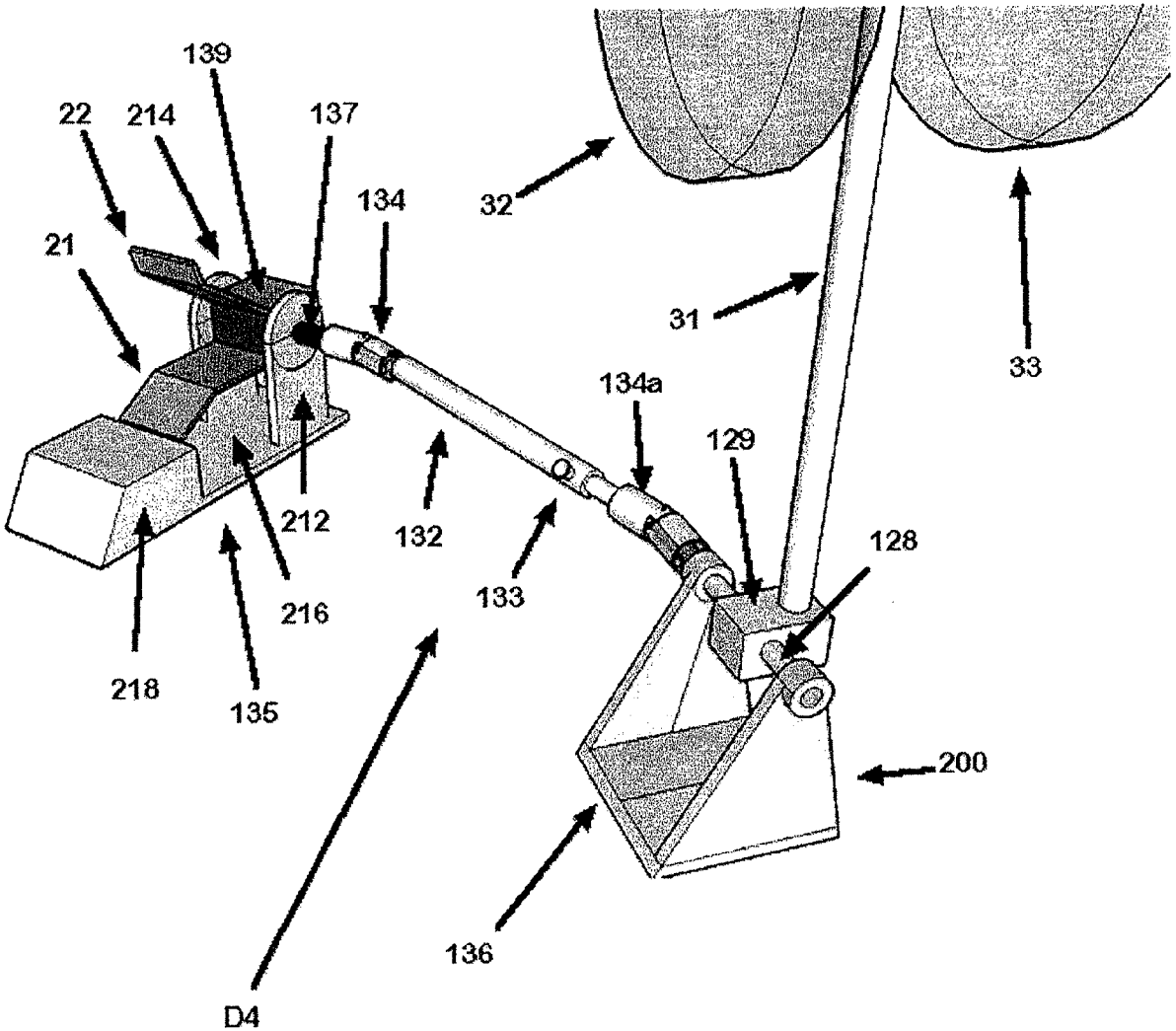
Figure 13A:
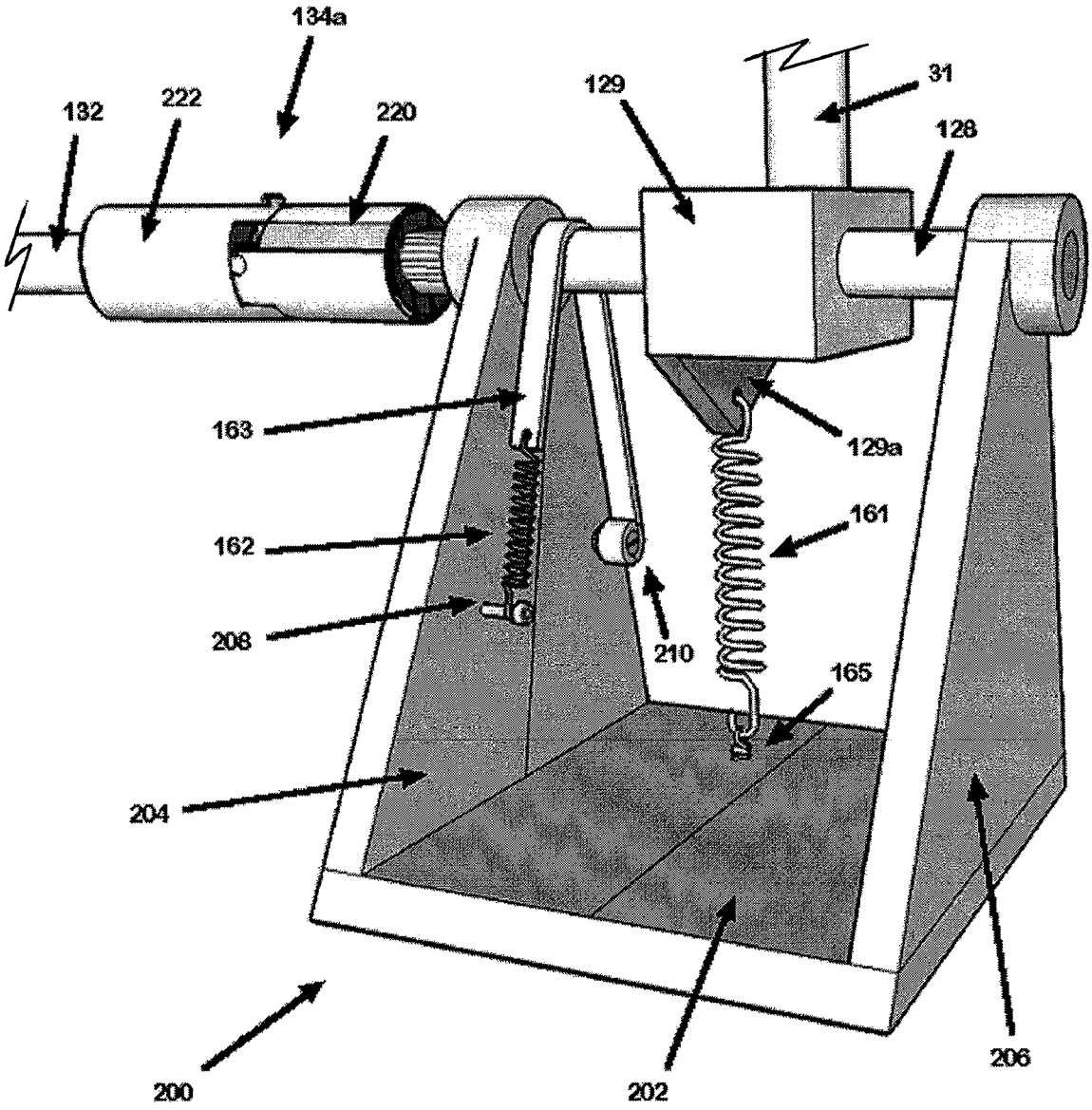
Figure 14:
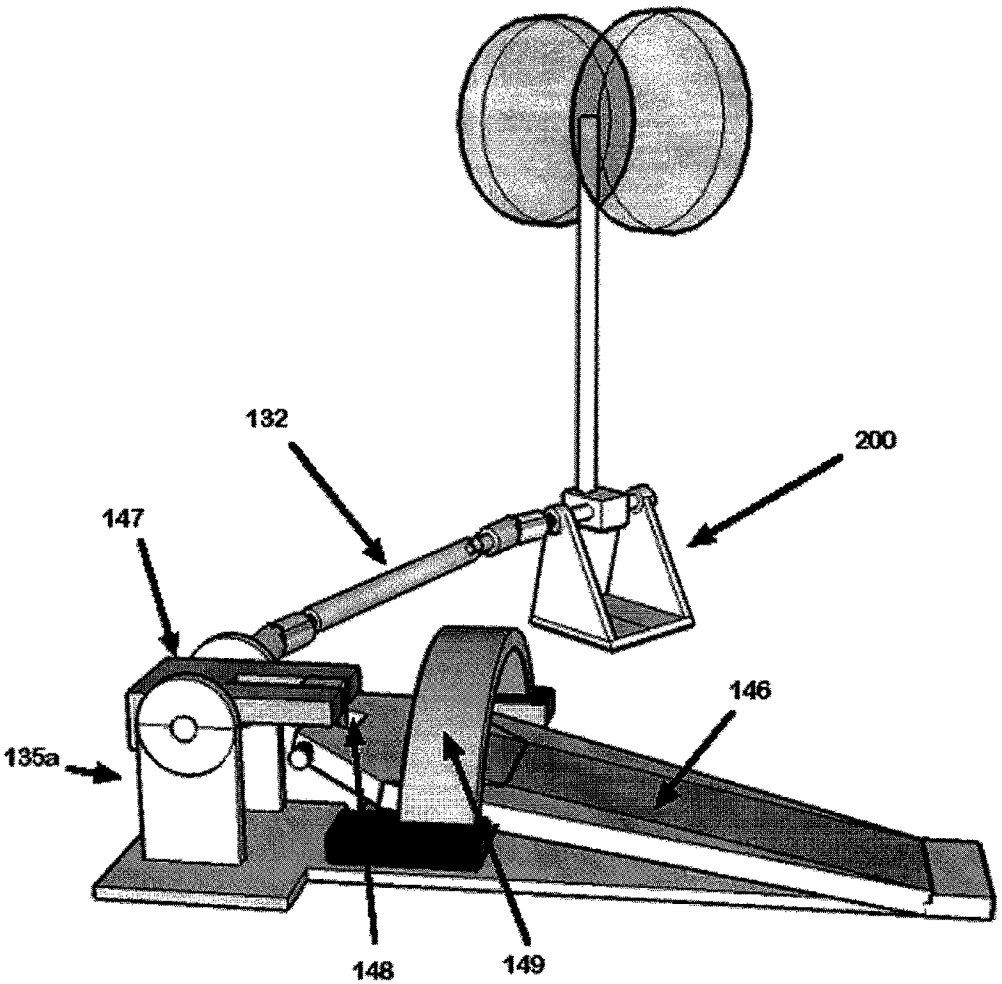
Figure 15:
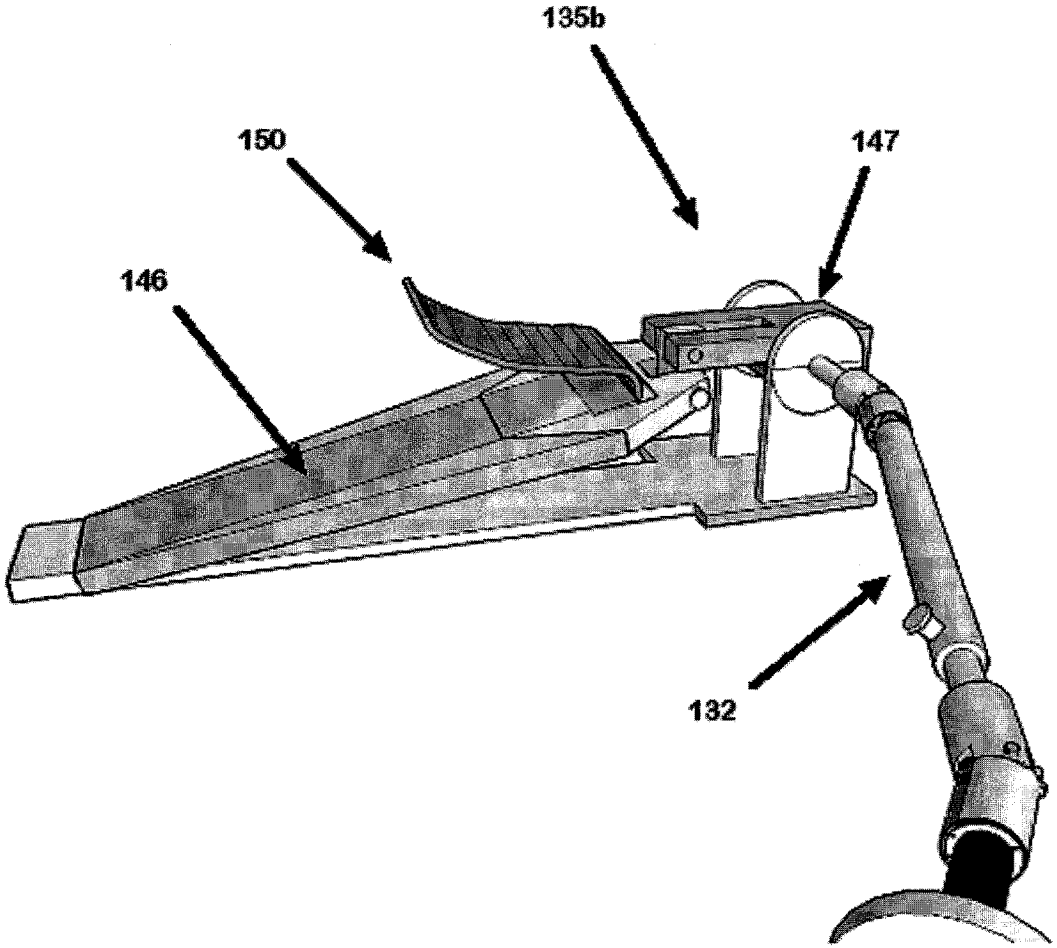
Figure 16:
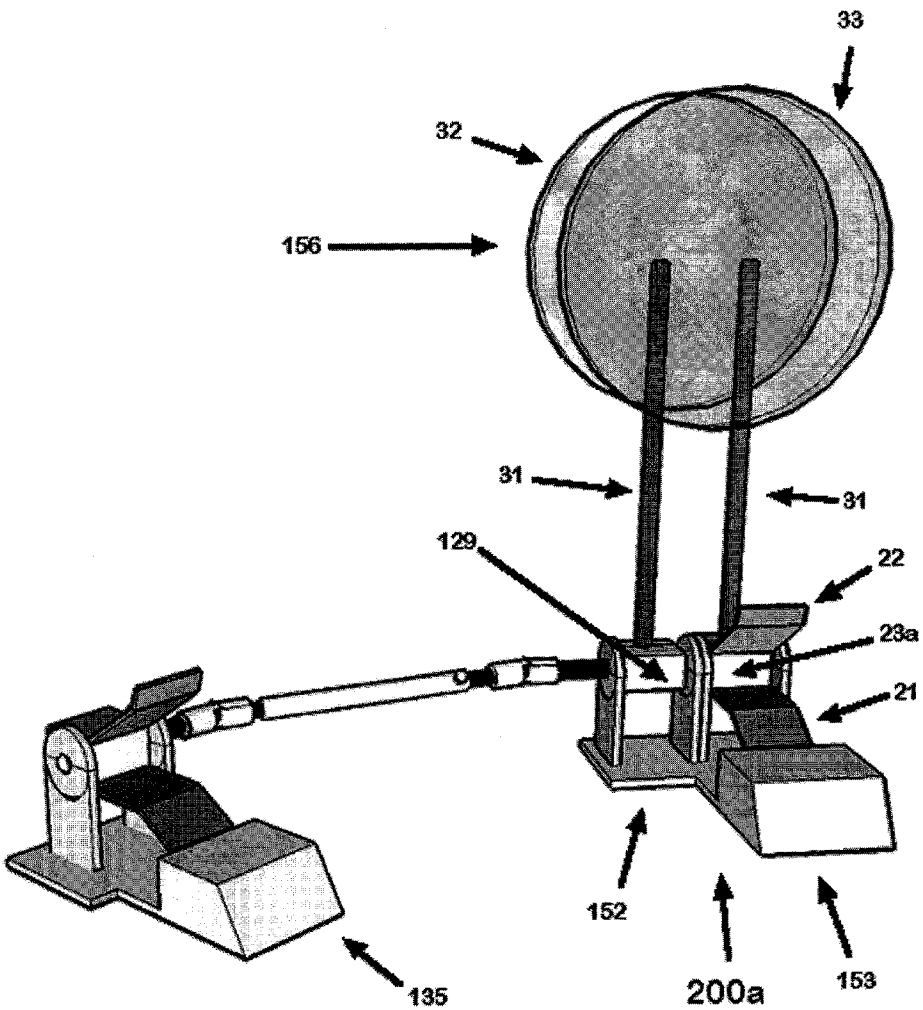
Figure 16A:
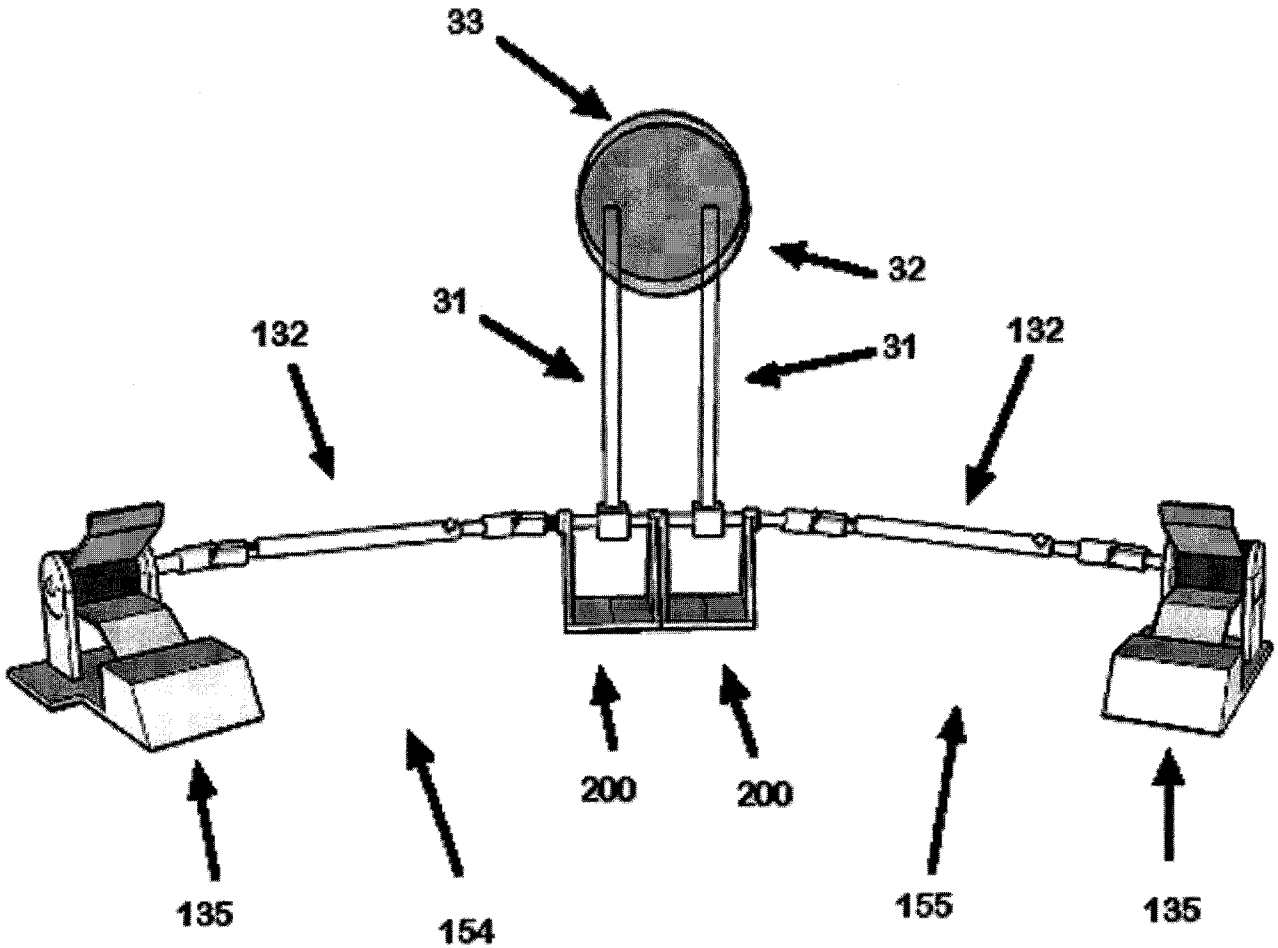
Figure 17:
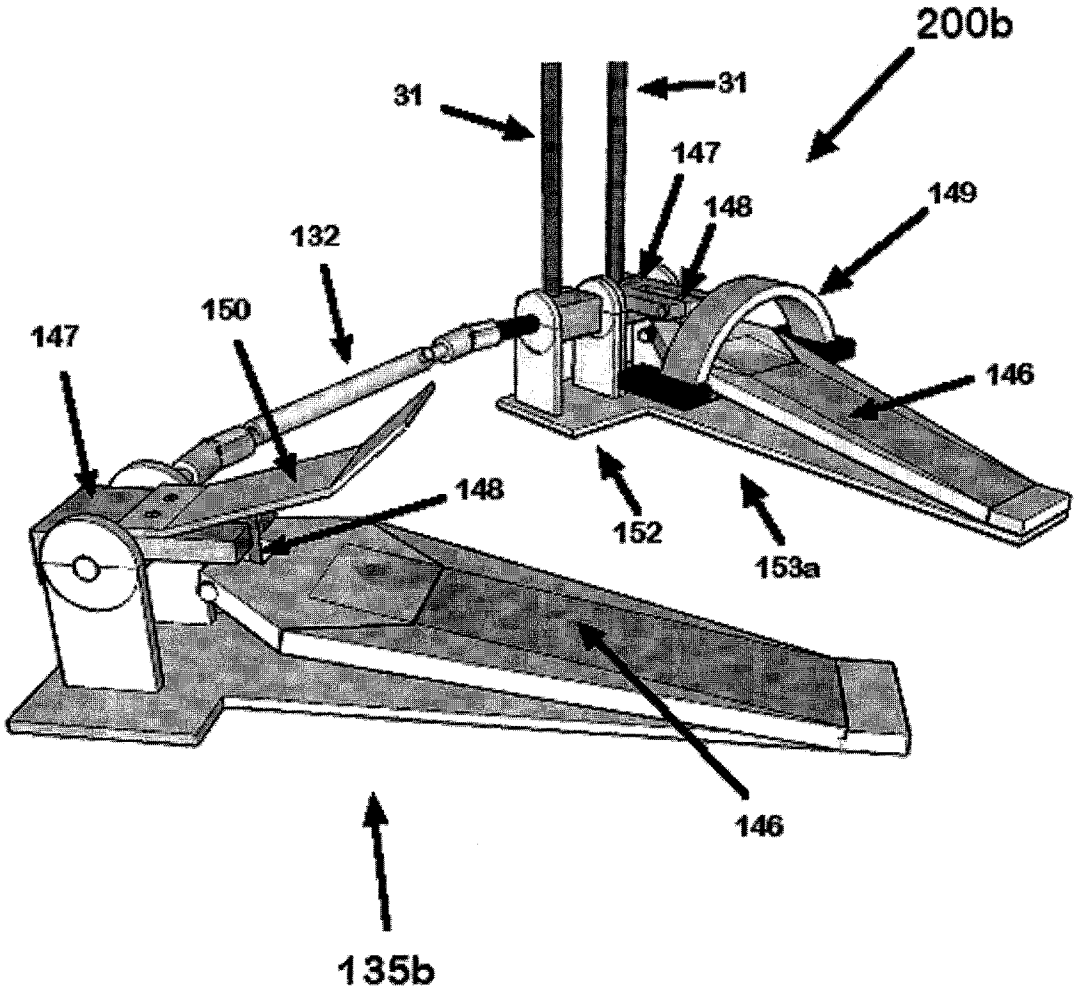
Figure 18:
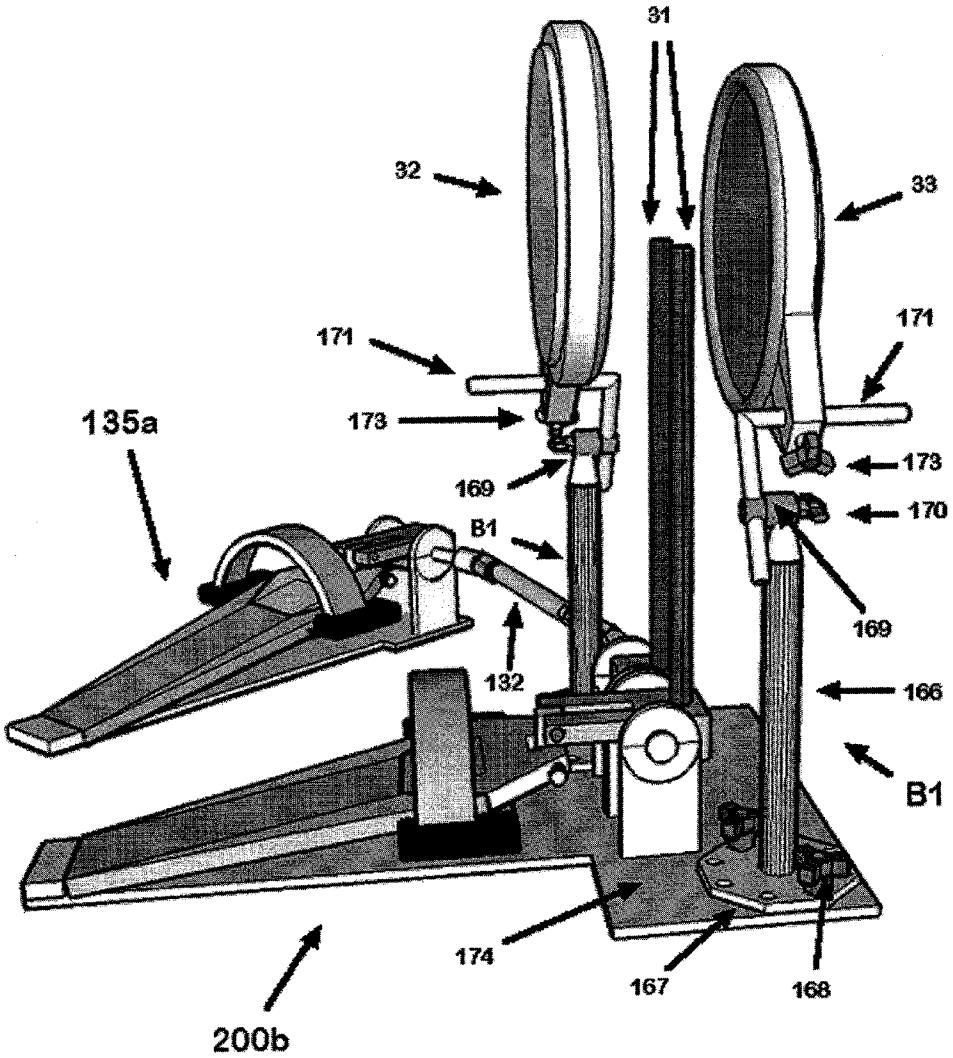
Figure 18B:
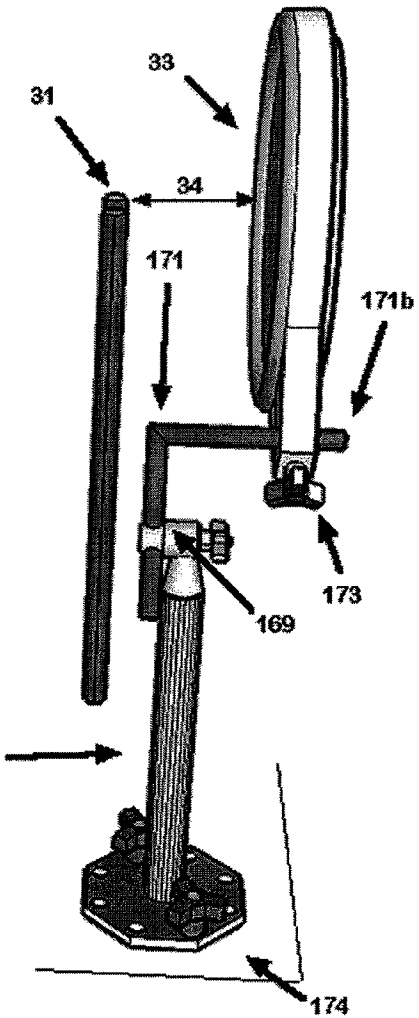
Figure 18A:
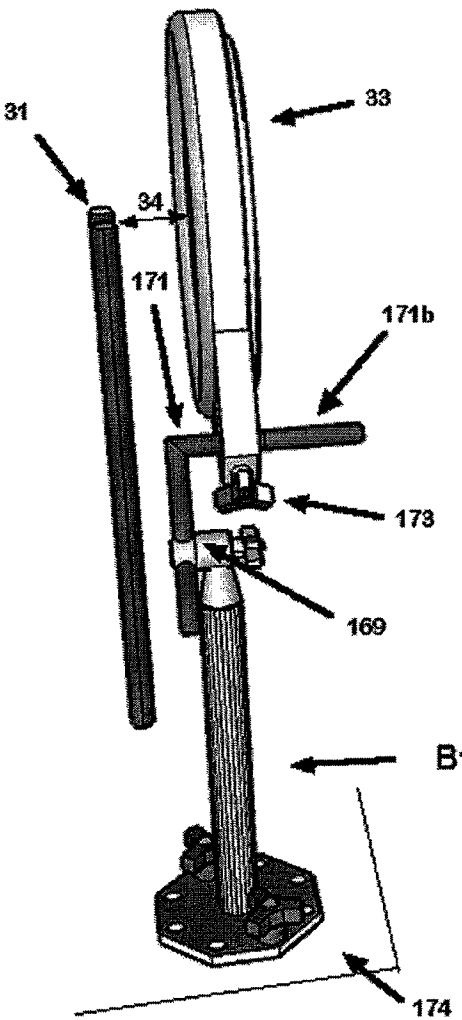
Figure 19:
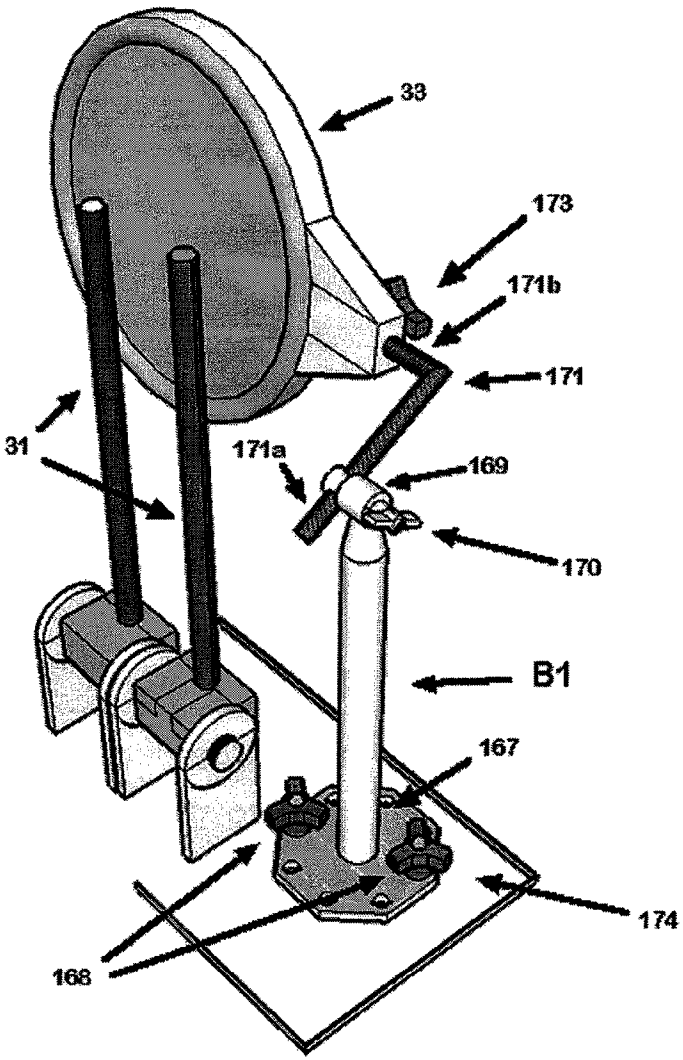
Figures 19A, 19B, 19C, 19D:
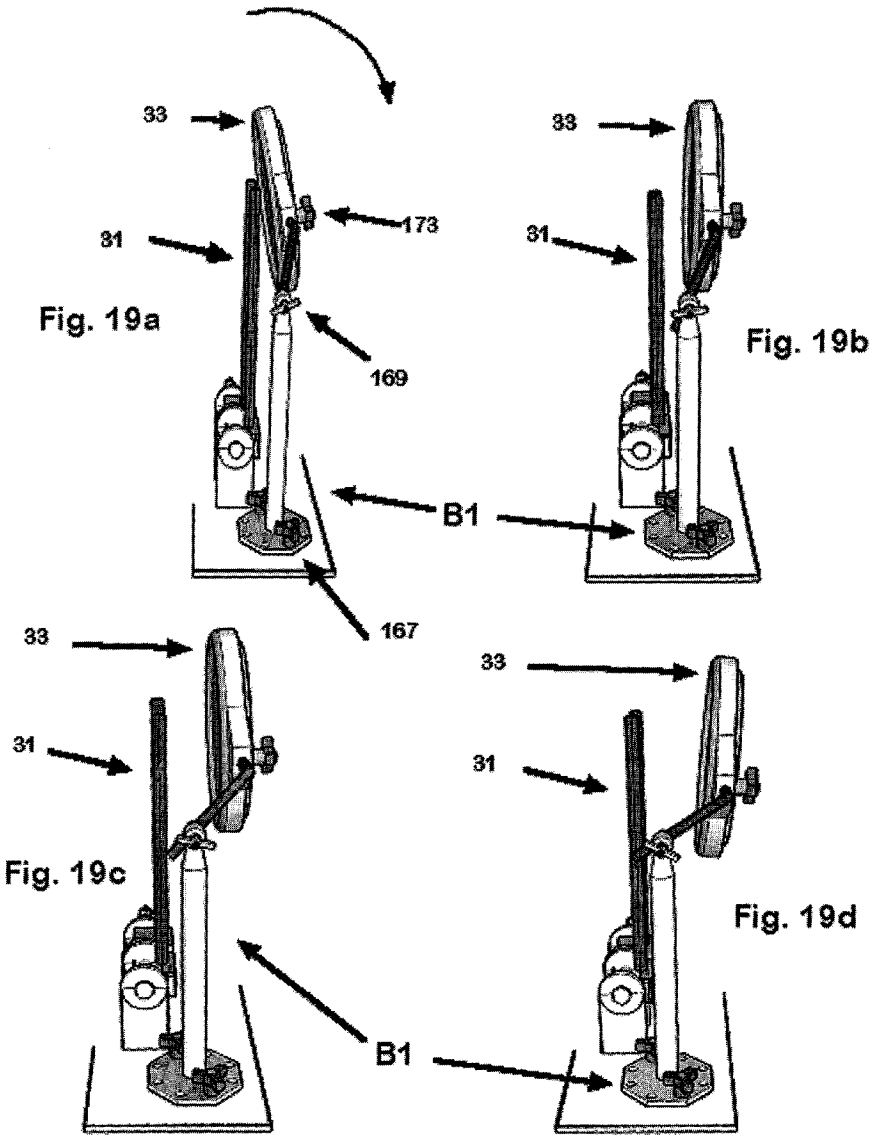
Figure 20A:
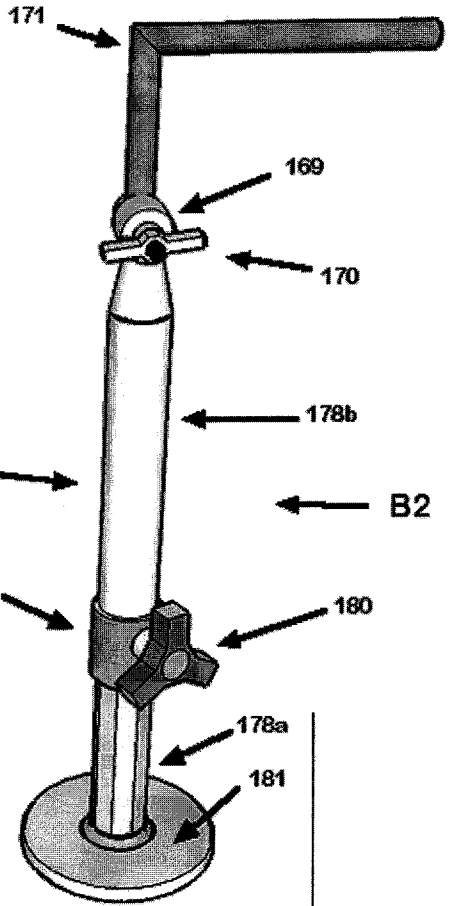
Figure 20:
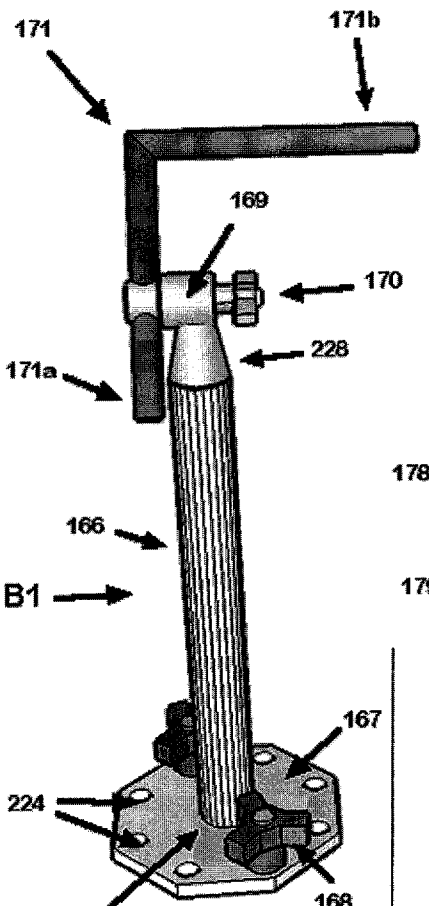

FIG. 2*a* is a perspective view of a bracket suitable for securing the rope to the base shown in FIG. 2;

FIG. 3 is a top view of an embodiment of the present invention including adjustable posts for existing drum tube triggers;

FIG. 4 is a fragmentary top view of an embodiment of the present invention including a return spring mounted to an axle;

FIG. 5 is a side view of an embodiment of the present invention including a spacer to widen the gap between tabs;

FIG. 5*a* is a side view showing a hinge in use and an adjustable return spring bracket;

FIG. 6 is fragmentary top view showing an embodiment of the present invention including a drag device;

FIG. 6*a* is a left side view showing the drag device of FIG. 6;

FIG. 7 is a rear view showing an embodiment of the present invention showing elements independently attached to a bass drum shell;

FIG. 7*a* is a rear view showing an embodiment of the present invention showing independently attached pad brackets and arms;

FIG. 8 is a side view showing an embodiment of the present invention showing a pedal configuration for use with a bass drum shell;

FIG. 9 is a side view of a conventional drum pedal at rest;

FIG. 9*a* is a side view of a conventional drum pedal striking a surface;

FIG. 10 is a side view of another embodiment of the present invention having a lower pedal and an upper tab;

FIG. 11 is a side view of another embodiment having a lower pedal with a foot retaining device;

FIG. 12 is a top view of the embodiment of FIG. 11;

FIG. 13 is a perspective view of a drum pedal assembly according to another embodiment;

FIG. 13*a* is a perspective view of a striking assembly according to the present invention;

FIG. 14 is a perspective view of a drum pedal assembly according to another embodiment;

FIG. 15 is a perspective view of a pedal assembly and connecting rod according to the present invention;

FIG. 16 is a perspective view of a drum pedal assembly according to another embodiment;

FIG. 16*a* is a perspective view of an arrangement of two drum pedal assemblies according to the present invention;

FIG. 17 is a perspective view of a drum pedal assembly according to another embodiment;

FIG. 18 is a perspective view of a drum pedal assembly and triggering device brackets according to the present invention;

FIG. 18*a* is a perspective view of a triggering device bracket showing a triggering device in a first orientation relative to a striking device;

FIG. 18*b* is a perspective view of the triggering device bracket of FIG. 18*a* showing the triggering device in a second orientation relative to the striking device;

FIG. 19 is a perspective view of a triggering device bracket and triggering device according to the present invention;

FIG. 19*a* is a perspective view of the triggering device bracket of FIG. 19 showing the triggering device bracket and triggering device in a first orientation relative to striking devices;

FIG. 19*b* is a perspective view of the triggering device bracket and triggering device of FIG. 19 in a second orientation;

FIG. 19*c* is a perspective view of the triggering device bracket and triggering device of FIG. 19 in a third orientation;

FIG. 19*d* is a perspective view of the triggering device bracket and triggering device of FIG. 19 in a fourth orientation;

FIG. 20 is a perspective view of a triggering device bracket according to the present invention; and FIG. 20*a* is a perspective view of a triggering device bracket according to another embodiment.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
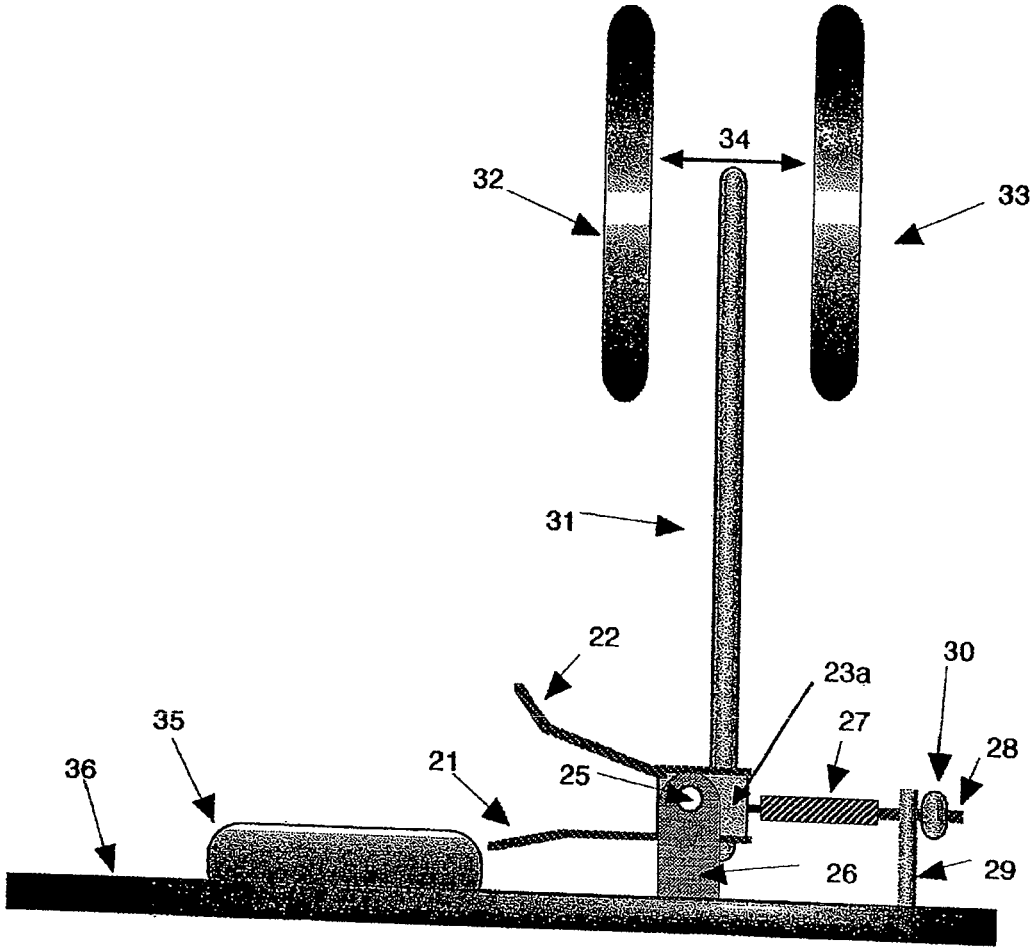
FIG. 1 is a side view of an embodiment of the present invention, with impact pad supports removed for clarity.

FIG. 1 shows a drum pedal assembly for electronic drums in accordance with one embodiment of the invention, wherein the parts identical to those shown in FIGS. 2 through 8 are designated by the same reference numerals. The disclosed drum pedal includes a lower pedal tab 21, or other type of extension, and an upper pedal tab 22, or other type of extension. Lower tab 21 and upper tab 22 are connected to a hub body 23*a* to form the main pedal assembly. This assembly rotates about an axle 25 which is suspended by axle stands 26 that are mounted to a pedal base 36. A return spring 27 is attached to the pedal assembly on one end and an adjustment screw 28 on the other. Adjustment screw 28 passes through a bracket 29 and tension may be varied using adjustment nut 30. A striking device 31, such as a stick, rod, tube or other extension, is attached on one end to the pedal assembly and the opposite end rests between two impact sensitive electronic drum triggering devices (pads, tubes or others) 32, 33. As lower pedal tab 21 is pressed down, striking device 31 hits downstroke triggering device 32. As the foot is lifted, upper pedal tab 22 is moved upward, and striking device 31 hits and triggers upstroke triggering device 33.

The arc of travel 34 between striking device 31 and either pad 32, 33 is approximately 1.5 inches. If a light wooden rod or aluminum tube 31 is used, the force required for playing the pedal apparatus is measured in ounces, rather than pounds. This allows for a relatively light return spring 27 tension, while the pedal still returns to the neutral position almost immediately. Also, upper upstroke pedal 22 allows for twice the number of beats per foot movement to be produced, effectively doubling the speed of an already very fast pedal.

Because the disclosed pedal is relatively light, fast and sensitive compared to conventional drum pedals, the weight of a drummer's foot preferably does not rest on the lower tab 21, or a sound will be produced. Therefore, a fixed footpad 35 may be provided. Footpad 35 is used to absorb most of the weight and downward force of the foot and leg.

The disclosed drum pedal is played by pushing the ball of the foot upon footpad 35, and tapping lower pedal tab 21 at the same time with the bottom of the toes so that striking device 31 actuates pad 32. A very light lifting of the toes will raise upper pedal tab 22 and subsequently trigger upstroke pad 33. Both pedal tabs 21, 22 preferably include distal ends having outwardly bent portions, which conform to the foot and optimize the mechanical response of the apparatus to foot movement.

FIG. 2 is a top view of another drum pedal assembly, which includes many of the same features described above. Identical features are referenced accordingly. In order to prevent the pedal base 36 from sliding during play, a rope 37 is attached to one leg of a drummer's stool or seat 38. The ends of rope 37 may be cleated to the device using jam cleats 39, 40. The rope ends can also be tied to the pedal base 36 using brackets 40*a*, shown in FIG. 2*a*, or some other similar device. The actual rope attachment method will vary depending upon the style of seat or throne used. This feature allows the drummer to vary his distance from and the angle relative to the apparatus. A non-skid surface may also be provided on the bottom of base 36.

As a means to adjust the position of the triggering pads, which effectively modifies the stroke length (arc of travel from at-rest to impact) of striking device 31, triggering pads 32, 33 may be suspended by angle brackets 41, 42, 43, 44. Each pad can be moved relative to striking device 31 by loosening adjustment knobs 45, 46, 47, 48, and then sliding brackets 41-44 along operably associated cutout tracks 49, 50, 51, 52. Knobs 45-48 are then re-tightened, thereby securing brackets 41-44 and thus triggering pads 32, 33 in place. Axle 25 is preferably supported by stands or brackets 26L, 26R, so that pedal assembly 23 rotates about axle 25. Optionally, bearings 53L, 53R may be provided on either side of pedal assembly 23 and surrounding axle 25.

A drum pedal assembly according to another embodiment is best shown in FIG. 3, which utilizes existing commercial drum trigger tubes ("Nimrods" or similar). In this case, trigger tubes 32*a*, 33*a* are mounted on vertical rods 54, 55 which are attached to adjustment plates 56, 57. The height of the triggering devices as well as the angle can be altered by using set screws 58, 59. The striking device 31 does not have to hit trigger tubes 32*a*, 33*a* at exactly 90 degrees. The attachment plates 56, 57 are further adjustable using cutout tracks 60, 61 and adjustment knobs 62, 63. There are dozens of triggering devices (pads, tubes, and others) on the market, and the disclosed invention may be used with most conventional triggering devices using various conventional mounting techniques.

The disclosed drum pedal may also include a rope restraining system similar to that described above, but having a different bearing system. Specifically, pedal assembly 23 is fixed to axle 25 which is suspended in bearings 65, 66 that are in turn mounted in suspension brackets or arms 26L, 26R. A variety of bearings, fittings, and configurations thereof can be used to allow the rotation of the pedal assembly. The device can also be constructed with no bearings at all.

A drum pedal assembly according to another embodiment is shown in FIG. 4, which includes pedal assembly 23 fixed to axle 67 that is suspended in bearings 68, 69 mounted in brackets or arms 70, 71. Extending from the axle is arm 72 that is connected to return spring 27 utilizing adjustment bracket, screw and nut 29, 28, 30 respectively.

FIG. 5 shows the main pedal assembly (with supports left out for clarity), and it illustrates optional spacer 73 that is used for drummers who wear shoes while playing or have thick feet. The thickness and number of spacers is in accordance with the drummer's preference. One method for combining the pedal tabs to form a main pedal assembly is shown in the use of pedal block 23*a* and four screws with nuts 94. There are several other possible ways to form the main pedal assembly. I have also included an optional weighted collar 92 that is held in position with set screw 93. Changing the position of this collar allows the drummer to vary the momentum (feel) of the device according to personal preference.

Shown in FIG. 5*a* is a bracket 29*a* for spring adjustment screw 28 and nut 30. Several holes in bracket 29*a* have been drilled at differing distances from the base 36. The angle of the at-rest position of the pedal assembly will change as the height of adjustment screw 28, and corresponding angle of return spring 27, is changed. Another difference depicted in this example is hinge 95 that is used in place of an axle to allow the main pedal assembly to rotate in an arc.

If the triggering devices (pads, tubes or others) are set in close proximity to the striking device, the return spring can sometimes cause the striking device to overshoot the at-rest position and hit the opposite pad unintentionally. To prevent this unwanted characteristic, a dampening device may be provided.

FIGS. 6 and 6*a* show a pedal assembly with an optional dampening device installed, in order to limit the free-play and spring induced oscillations of pedal assembly 23. Main pedal assembly 23 is fixed to axle 25 with bearings and brackets in the same configuration as FIG. 3. Strap 74 is wrapped around axle 25 then both ends are routed under raised bar 75 which is attached to the base of the apparatus. Bar 75 is elevated just enough for the strap ends to pass under and move freely. Spring 76 or other elastic device has one end attached to strap ends 78 and the other end of spring 76 is attached to the base with set screw 77. The tighter spring 76 tension becomes, the more free-play is reduced. This allows the triggering pads (not shown) to be placed extremely close to striking device 31 without the fear of unintended triggering caused by the pedal assembly overshooting the neutral position.

FIGS. 7 and 8 illustrate a modification to allow drummers to use a conventional drum shell in conjunction with the present invention. Many drummers will want the look of a conventional set to remain the same, and many tom-toms and other accessories are mounted on bass drum shells. FIGS. 7 and 7*a* are identical except for the attachment points of the pad arms.

After the rear drum head and all attachment hardware are removed as in FIGS. 7 and 7*a*, the pedal apparatus is mounted to the bottom of the shell. Pad support bracket 79 in FIG. 7 is mounted independently from the pedal apparatus. Each pad or tube or other triggering device can be mounted almost anywhere around the shell of the drum, and can be attached independently from each other as in 79*a* and 79*b* in FIG. 7*a*. The angle of pad arms 80, 81 can be varied using adjustment devices 82, 83.

Illustrated is the use of triggering devices (pads) 32, 33, each with embedded multiple electronic sensors (piezo transducers or other; 84, 85 in pad 32, 86 and 87 in pad 33). Two per pad is shown, but any number could be added. The configuration illustrated would allow a drummer to trigger blended sounds such as a bass drum and a cow bell on the downstroke, along with a conga and a gong on the upstroke (as just one example). There are literally hundreds of sound choices available in modern drum modules (sound generating computers), and my pedal takes advantage of the technology available.

FIG. 8 further illustrates the flexibility of my invention, and adds detail to one possible pedal configuration as used in FIGS. 7 and 7*a*. With the rear drum head and all hardware removed, base 36 is attached to the bass drum shell 88 using clip or bracket 89. Right support arm 26R remains the same, but left arm 92 has been lengthened to accept the hardware requirements of a vertically mounted return spring mechanism. One end of spring 27 is attached to a tab (or arm or other) 90 that is attached to the main pedal assembly. The other end of spring 27 is attached to adjustment screw 28 that goes through bracket 91 which is attached to left arm 92. Adjustment nut 30 is used to vary return spring tension. Either arm could be modified in this fashion; it doesn't necessarily have to be the left arm.

Also note in FIG. 8 that the striking device (tube, stick or other) 31 does not have to be attached vertically with respect to the main pedal assembly. Any angle will work, as long as striking device 31 returns to a neutral (at-rest) position between the triggering devices 32,33 and foot movement is not impeded. Striking device 31 can vary in length, weight or composition depending upon drummer preference.

There are two common methods used for playing drum pedals. In the first method, the ball of the foot is pressed down as the entire leg moves up and down. This is commonly referred to as the "heel-up" method. A second technique entails leaving the heel of the foot down, and pivoting at the ankle alone for pedal actuation. This method is referred to as the "heel-down" method. The drum pedal assemblies described above are well suited for drummers using the heel-up technique, but may not be as desirable for drummers accustomed to the heel-down method. Therefore, two additional embodiments are provided that are well suited for heel-down drummers.

A drum pedal D2 assembly according to another embodiment is shown in FIG. 10. Drum pedal D2 includes some of the same features of the drum pedal assemblies described above, and are identified with like reference numerals. Support stands, return and drag devices are not shown for purposes of explanation. However, it should be understood that drum pedal D2 may include any or all such features described above. While the upper tab 22 has been retained, note that the lower tab has been replaced by a pedal 118 connected to the hub body 23*a* using a linkage 117. A heel plate 120 with a hinge pin 118*b* is used to anchor the back of the pedal 118 to the base 36. The linkage 117 has several holes that can be used to attach the hinge pin at the front of the pedal 118*a* in order to adjust the spacing between the pedal 118 and the upper tab 22. The upper linkage hinge piece 116 or arm may be an integral part of the core block 23*a*, or it may be an added, adjustable piece. The leverage and stroke length of the pedal 118 are varied depending on the positioning of the upper linkage hinge piece 116 relative to hub body 23*a*.

As the pedal 118 is pressed down, the hub body 23*a* rotates about the axle 25, and the striking device 31 impacts the downstroke triggering device 32. As the upper tab 22 is lifted up with the top of the foot, the core block 23*a* rotates around the axle 25 and the upstroke triggering device 33 is impacted, as described above.

Some drummers who use the heel-down technique will not be able to reach the upstroke tab as presented in FIG. 10. This may be caused by the drummer having a short foot (kids for instance) or a technique that leaves the foot too far back in the pedal to reach the tab. As best shown in FIGS. 11 and 12, a drum pedal assembly D3 according to another embodiment may be better suited for such drummers. As with drum pedal D2, pedal 118 and linkage 117 are provided for pressing down, but upper tab 22 has been omitted.

Instead, drum pedal D3 includes a foot retaining device 121. This device could take one of many forms; a cup, a shoe wedge, a toe clip etc., as long as it can be used to receive a user's foot and be used to raise the pedal 118 when the foot is lifted. As shown in FIGS. 11 and 12, a padded strap 121 with an adjustable fastener 122, such as Velcro™, is provided. Retaining device 121 can be moved forward or back on the pedal 118 at the discretion of the drummer by using retaining screws 123 in any of the adjustment holes 124. The actual size of the device and resultant snugness around the foot can therefore be adjusted using the Velcro™ or other adjustment fastener 122.

Linkage 117 is preferably a rigid strip of material, and the optional adjustment feature of the upper linkage hinge piece 116 is shown in FIG. 12, using set screws 125 that go into adjustment holes 126. In this way, the distal end of linkage hinge piece 116 may be moved further away from or closer to hub body 23*a*. As the pedal 118 is pressed down, the hub body 23*a* rotates about the axle 25, and the striking device 31 impacts the downstroke triggering device 32. As the pedal is lifted upwards with the aid of the foot retaining device, hub body 23*a* rotates around the axle 25 and the upstroke triggering device 33 is impacted.

A remote drum pedal assembly D4 according to another embodiment is shown in FIG. 13, which accommodates drummers that want to trigger sounds with two feet, or drummers that want to separate the pedal assembly from the striking assembly and pads. Pedal assembly D4 includes some of the same features of the drum pedal assemblies described above, and they are identified with like reference numerals. Return and drag devices are not shown for purposes of explanation. However, it should be understood that drum pedal D4 may include any or all such features described below.

Remote drum pedal assembly D4 includes a striking assembly 200 having a base 202 and spaced left and right support walls 204, 206, as shown in FIG. 13*a*. A striking assembly axle 128 is rotatably disposed between support walls 204, 206. Axle 128 supports a striking assembly hub 129, which rotates with axle 128. Striking device 31 is attached on one end to striking assembly hub 129. The opposite distal end of striking device 31 may be disposed between impact sensitive electronic drum triggering devices 32, 33, as described above.

As shown in FIG. 13*a*, striking assembly 200 may include a return spring 161 disposed between and connecting base 202 and striking assembly hub 129. Striking assembly hub 129 may include a flange 129*a* extending downwardly from an underside thereof, with a hole or other portion configured for attaching one end of return spring 161. Base 202 may include an adjustment screw 165 or the like for adjusting the tension of return spring 161. Return spring 161 is preferably positioned and tensionably adjusted so that striking assembly hub 129 is biased toward an 'at-rest' position. In this way, striking device 31 may be biased toward an at-rest position, such that the distal end thereof is maintained between the two triggering devices 32, 33 when axle 128 is not being rotated. Alternatively, or in addition, a return spring may be provided on a remote pedal assembly 135 of assembly D4, described in further detail below.

A dampening assembly may be provided on striking assembly 200 for preventing striking device 31 from overshooting the at-rest position between triggering devices 32, 33. A dampening spring 162 may be provided. One end of dampening spring 162 is attached to a pin 208 or other attachment member on support wall 204. The opposite end of dampening spring 162 attached to an end of a strap 163, piece of rope, or other flexible material. Strap 163 extends up and around axle 128, with the opposite end thereof attached to another pin 210 or fastening member. Strap 163 is sufficiently tensioned against axle 128 via dampening spring 162, so that axle 128 is permitted to rotate but will not spin freely or wobble undesirably. In this way, strap 163 produces a dampening effect on the rotation of axle 128. Such a dampening assembly may be provided on either the striking assembly axle 128, as shown in FIG. 13*a*, or alternatively on the remote pedal assembly axle 137, described in further detail below.

Referring again to FIG. 13, remote pedal assembly 135 includes a hub body 139. Similar to hub body 23*a*, lower and upper tabs 21, 22 are connected to hub body 139. Hub body 139 is disposed on a pedal assembly axle 137, which in turn is rotatably suspended between first and second axle support walls 212, 214. Support walls 212, 214 extend upwardly from an end of a pedal assembly base 216. Base 216 may include a footpad 218 disposed proximate to an end opposite support walls 212, 214.

Pedal assembly axle 137 is coupled to striking assembly axle 128 via a connecting rod 132. Connecting rod 132 may include first and second telescoping rods, so that the length of connecting rod 132 may be easily adjusted. The length of the telescoping rods may then be maintained using one or more set screws 133. Preferably, opposite ends of connecting rod 132 are coupled to axles 137, 128 via universal joints 134, 134*a*, respectively. As shown in FIG. 13*a*, universal joint 134*a* includes a first portion 220 pivotably attached to a second portion 222, so that the relative angle between connecting rod 132 and axle 128 may be adjusted. Universal joint 134 is similarly configured, so that the relative angle between connecting rod 132 and axle 137 may be adjusted. In this way, the relative angle between remote pedal assembly 135 and striking assembly 200 may be adjusted, while smoothly transferring the rotational force of axle 137 when tab 21 is depressed or tab 22 is lifted.

It should be understood that connecting rod 132 may be coupled to other pedal assemblies. For example, a remote pedal assembly 135*a* may be provided which is similar to drum pedal assembly D2, as shown in FIG. 14. Pedal assembly 135*a* includes a pedal 146 attached to a remote hub assembly 147 via a linkage 148. Similar to linkage 117, pedal 146 and linkage 148 are provided for pressing down on the drummer's down stroke. A foot retaining strap 149 causes pedal 146 to lift up on the upstroke. Alternatively, a pedal assembly 135*b* having a toe clip 150 may be provided, as shown in FIG. 15. In either case, the strap 149 or clip 150 causes hub assembly 147 to rotate when the drummer's foot is lifted. This causes the associated pedal assembly axle 137 to rotate, which is coupled to and thereby rotates striking assembly axle 128 via connecting rod 132. Thus, lowering pedal 146 causes striking device 31 to impact the downstroke pad (e.g. triggering device 32), and raising pedal 146 causes striking device 31 to impact the upstroke pad (e.g. triggering device 33).

Other configurations for pedal assembly 135 (or 135*a*, 135*b*) and striking assembly 200 may also be provided. For example, drum pedal assembly 135 may be coupled to a striking assembly 200*a* which includes a first portion 152 similar to striking assembly 200, such as shown in FIG. 13, and a second portion 153, as shown in FIG. 16. Accordingly, first portion 152 includes striking assembly hub 129 and striking device 31. Second portion 153 is a second pedal assembly having tabs 21, 22 connected to hub body 23*a*, as described above. A second striking device 31 extends outwardly from hub body 23*a*. Hub body 23*a* of second portion 153 rotates independently from striking assembly hub 129. Both striking devices 31 may be disposed between triggering devices 32, 33, so that triggering devices 32, 33 are shared and may be triggered by either pedal assembly 135 or the pedal assembly of second portion 153.

First and second portions 152, 153 of striking assembly 200*a* may include an integrally formed base, as shown in FIG. 16. Alternatively, striking assembly 200 may be provided, which is simply positioned next to another pedal assembly, such as the pedal assembly shown in FIG. 1, or shown in FIG. 10.

Alternatively, two remote drum pedal assemblies D4 may be used in conjunction, as shown in FIG. 16*a*. A left assembly 154 and a right assembly 155 may be positioned to share two electronic triggering devices 32, 33. With respect to right assembly 155, note that connecting rod 132 may be coupled to the left side of pedal assembly 135, so that connecting rods 132 extend inwardly and toward one another, thereby aligning striking assemblies 200 of left and right assemblies 154, 155.

It should be understood that for embodiments including two pedal assemblies, the pedal assemblies need not be the same. For example, drum pedal assembly 135*b*, such as shown in FIG. 17, may be coupled to a striking assembly 200*b* including first portion 152, as described above, and a second portion 153*a* having pedal 146 attached to a hub assembly 147 via a linkage 148, as shown in FIG. 17. Thus, it would be readily understood by one skilled in the art that numerous combinations may be used by drawing on features of the separate embodiments.

As previously disclosed, the length of travel 34 between striking device(s) 31 and their corresponding triggering devices 32, 33 may be modified by adjusting the position of triggering devices 32, 33. Indeed, a relatively slight change in distance between striking device(s) 31 and triggering devices 32, 33 can change the timing of notes to a very large degree. An adjustable bracket for holding readily available commercial triggering devices for use with any of the pedal assemblies disclosed herein is desirable.

A universal drum pad bracket B1 according to a first embodiment and suitable for use with any of the disclosed drum pedal assemblies disclosed herein is shown in FIGS. 18 through 20. Referring to FIG. 20, bracket B1 includes a support pole 166 having a lower end 226 attached to a base 167 and a free distal end 228. Base 167 may be configured as a flange extending outwardly from lower end 226 and having a diameter greater than the diameter of support pole 166. Preferably, base 167 has two or more mounting holes 224, through which threaded base attachment knobs 168, or some other fasteners, may be used to mount the bracket base 167 to a pedal base 174. The user may selected any two opposing holes of the plurality of mounting holes 224, thereby enabling the user to rotate and mount bracket B1 in a selected orientation.

A clamping device 169 is attached to end 228 of support pole 166, which is used to secure a drum pad mounting rod 171. Note that first leg 171*a* of mounting rod 171 is preferably disposed at an angle of about 90° relative to second leg 171*b*. Of course, it should be understood that first leg 171*a* and second leg 171*b* may be disposed at other angles relative to each other.

Preferably, clamping device 169 includes an opening or sleeve through which a first leg 171*a* of rod 171 extends. A fastener or clamp adjustment knob 170 is provided for clamping device 169. In this way, mounting rod 171 may be releasably secured in a selected position by the user by tightening adjustment knob 170. When adjustment knob 170 is loosened, mounting rod 171 may be rotated to a desired angle relative to support pole 166. Second leg 171*b* may be moved toward or away from support pole 166 by sliding first leg 171*a* within the corresponding opening in clamping device 169. In addition, first leg 171*a* may be rotated within the corresponding opening in clamping device 169. Further, the opening on clamping device 169 may be rotatably disposed relative to support pole 166, so that first leg 171*a* may be pivoted to a desired angle. Adjustment examples follow.

As shown in FIG. 18, two brackets B1 are mounted on base 174. Brackets B1 are selectively positioned on base 174 with corresponding triggering devices 32, 33 attached thereto so that striking devices 31 are disposed between triggering devices 32, 33 at a selected neutral position. The length of travel 34 between striking devices 31 and triggering device 33 in FIGS. 18*a*, 18*b* is modified by adjusting the position of the corresponding triggering device 33 on second leg 171*b*. Only a single bracket and pad are shown for clarity. Given bracket B1 is secured to base 174, and striking devices 31 are in a fixed position when at-rest in the neutral position, the arc of travel 34 may be easily adjusted by simply sliding triggering device 33 on second leg 171*b* toward or away from striking device 31. FIG. 18*a* shows electronic triggering device 33 attached to second leg 171*b* in a first orientation. FIG. 18*b* shows electronic triggering device 33 attached to second leg 171*b* in a second orientation.

Drum bracket B1 in FIG. 18*a* accommodates many commercially available electronic drum pads, wherein second leg 171*b* extends through an opening in the drum pad that is perpendicular to the striking surface. Note that bracket B1 may also be adjusted to accommodate commercially available electronic drum pads that have a different mounting system, as shown in FIG. 19. First leg 171*a* has been rotated so that second leg 171*b* may be inserted into an opening on the side of a drum pad 33, parallel to the striking surface. In addition, bracket B1 may be rotated and secured to base 174 so that the orientation of clamping device 169 is adjusted relative to the triggering device. For example, see FIG. 19 wherein bracket B1 has been rotated about 90° compared to the orientation of bracket B1 shown in FIG. 18. As described above, base attachment knobs 168 may be removed, bracket B1 rotated as desired, and then knobs 168 re-attached.

As shown in FIGS. 19*a*-19*d*, the orientation of electronic triggering device 33 relative to striking device(s) 31 may be adjusted. FIG. 19*a* shows bracket B1 and triggering device 33 in a first orientation; FIG. 19*b* shows bracket B1 and triggering device 33 in a second orientation; FIG. 19*c* shows bracket B1 and triggering device 33 in a third orientation; and FIG. 19*d* shows bracket B1 and triggering device 33 in a fourth orientation. Note that clamping device 169 may be adjusted so that the triggering device 33 moves in an arc away from or towards striking device 31. Moreover, triggering device 33 may be rotated so that the angle of its striking surface is adjusted relative to striking device 31.

A universal drum pad bracket B2 according to another embodiment is shown in FIG. 20*a*. Bracket B2 is similar to bracket B1, but includes a telescoping support pole 178 having a lower pole part 178*a* and an upper pole part 178*b*. Lower pole part 178*a* is slidably received into upper pole part 178*b*. Lower pole part 178*a* may be attached to a mounting flange 181, which is attached directly to pedal base 174. Alternatively, lower pole part 178*a* may be directly attached to base 174, thereby eliminating the need for mounting flange 181.

Upper pole part 178*b* includes clamping device 169, which secures mounting rod 171, as described above. In addition, the height of bracket B2 may be adjusted by sliding upper pole part 178*b* and lower pole part 178*a* apart. A desired height may be maintained by tightening a support pole knob 180 associated with a clamp 179. Accordingly, the height of bracket B2 may be adjusted by loosening knob 180, raising or lowering upper pole part 178*b*, and then tightening knob 180. In addition, upper pole part 178*b* may be adjustably rotated relative to lower pole part 178*a*, thereby changing the orientation of clamping device 169 and rod 171 as desired.

Universal electronic drum pad brackets B1, B2 are particularly suitable for use with any of the drum pedal assemblies disclosed herein. In addition, brackets B1, B2 may be used with most other commercially available drum pedal assemblies. They are fully adjustable and hold drum pads securely.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims. In addition, features of one embodiment may be incorporated into another embodiment.

I claim:

1. An apparatus for triggering electronic drums, comprising:

a pedal assembly base;

a first hub body rotatably connected to said pedal assembly base;

a first extension extending outwardly from and coupled to said first hub body, wherein said first hub body rotates in a first direction when said first extension is depressed, and said first hub body rotates in an opposite second direction when said first extension is raised;

a striking assembly base spaced from said pedal base;

a second hub body rotatably connected to said striking assembly base;

a connecting rod having a first end coupled to said first hub body and an opposite second end coupled to said second hub body, said connecting rod transferring a rotational force to said second hub body when said first hub body rotates;

a first impact sensitive electronic triggering device;

a second impact sensitive electronic triggering device;

a striking device having a first end connected to said second hub body and a distal second end extending outwardly therefrom and disposed between said first and second triggering devices, said striking device contacting said first triggering device when said first extension is depressed, and said striking device contacting said second triggering device when said first extension is raised;

a third hub body rotatably disposed adjacent said second hub body, said second and third hub bodies independently rotatable;

a second extension connected to said third hub body, wherein said third hub body rotates in a first direction when said second extension is depressed, and said third hub body rotates in an opposite second direction when said second extension is raised;

a second striking device having a first end connected to said third hub body and a distal second end extending outwardly therefrom and disposed between said first and second triggering devices, said second striking device contacting said first triggering device when said second extension is depressed, and said second striking device contacting said second triggering device when said second extension is raised.

2. The apparatus of claim 1, further comprising an axle assembly associated with each of said first and second hub bodies and connecting a corresponding one of said first and second hub bodies to a corresponding one of said pedal and striking assembly bases, said axle assembly having an axle disposed between and supported by first and second axle arms, the corresponding one of said first and second hub bodies connected to said axle.

3. The apparatus of claim 2, wherein at least one of said axle assemblies includes a return spring having a first end connected to the corresponding one of said first and second hub bodies and a second end connected the corresponding one of said pedal and striking assembly bases, said return spring tensionably biasing the corresponding one of said first and second hub bodies toward a neutral position.

4. The apparatus of claim 3, wherein said second end of said return spring is connected to an adjustment screw on the corresponding one of said pedal and striking assembly bases, said adjustment screw for adjusting tension of said return spring.

5. The apparatus of claim 2, wherein at least one of said axle assemblies includes a dampening assembly, said dampening assembly having a strap having first and second opposite ends connected to the corresponding one of said pedal and striking assembly bases and a central portion wrapped around said axle, said central portion tensioned against said axle, thereby minimizing rotation of said axle beyond a neutral position.

6. The apparatus of claim 5, wherein said dampening assembly includes a dampening spring having a first end attached to a first end of said strap and a second end attached to the corresponding one of said pedal and striking assembly bases, said dampening spring maintaining a desired level of tension on said strap.

7. The apparatus of claim 6, wherein said dampening spring is connected to the corresponding one of said pedal and striking assembly bases via an adjustment screw, said adjustment screw for adjusting tension of said dampening spring.

8. The apparatus of claim 2, wherein said connecting rod includes a first end coupled to said axle associated with said first hub body and a second end coupled to said axle associated with said second hub body.

9. The apparatus of claim 8, further comprising a universal joint pivotally coupling at least one of said first and second ends of said connecting rod to said axle of the corresponding one of said first and second hub bodies.

10. The apparatus of claim 1, further comprising an upper tab extending outwardly from said first hub body, said first extension directly connected to and extending outwardly from said first hub body, said upper tab spaced from said first extension to form a space therebetween for receiving a user's toes.

11. The apparatus of claim 1, wherein said first extension is a pedal pivotally connected to said first hub body via a linkage, said linkage having a first portion pivotally connected to said first hub body and a second portion pivotally connected to said pedal.

12. The apparatus of claim 11, further comprising a foot retaining device attached to said pedal for securing a user's foot to said pedal, wherein said pedal is raised via an upward force against said foot retaining device.

13. The apparatus of claim 1, further comprising an upper tab extending outwardly from said third hub body, said second extension directly connected to and extending outwardly from said third hub body, said upper tab spaced from said second extension to form a space therebetween for receiving a user's toes.

14. The apparatus of claim 1, wherein said second extension is a pedal pivotally connected to said third hub body via a linkage, said linkage having a first portion pivotally connected to said third hub body and a second portion pivotally connected to said pedal.

15. The apparatus of claim 14, further comprising a foot retaining device attached to said pedal for securing a user's foot to said pedal, wherein said pedal is raised via an upward force against said foot retaining device.

16. The apparatus of claim 1, wherein said pedal includes a first end pivotally connected to said linkage and a second end pivotally connected to said striking assembly base.

17. The apparatus of claim 1, wherein said connecting rod includes first and second telescoping rods so that a length of said connecting rod is adjustable.

18. The apparatus of claim 1, further comprising a triggering device bracket for holding one of said first and second triggering devices in a selected position, said triggering device bracket comprising:

a support pole having a first end connected to said striking assembly base and a second distal end;

a clamping device connected to said second distal end, said clamping device having an opening;

a mounting rod having a first leg extending through said opening and a second leg, wherein one of said first and second triggering devices is disposed on said second leg and securably moveable thereon toward or away from a corresponding striking device.

19. The apparatus of claim 18, wherein said first leg is moveably secured within said opening of said clamping device via an adjustment knob.

20. The apparatus of claim 18, wherein said clamping device includes a first portion pivotably disposed relative to a second portion, said first portion connected to said second distal end and said second portion connected to said first leg so that said mounting rod is pivotable relative to said support pole.

21. The apparatus of claim 18, wherein said triggering device bracket further comprises a bracket base connected to said first end of said support pole, said bracket base having a plurality of holes, and at least one fastener that extends through one of said plurality of holes so that said support pole is removably connected to said striking assembly base.

22. The apparatus of claim 18, wherein said support pole includes telescoping first and second parts.

23. The apparatus of claim 18, wherein said first leg is substantially perpendicular to said second leg.

* * * * *